US010147411B2

(12) United States Patent
Dzhigan et al.

(10) Patent No.: US 10,147,411 B2
(45) Date of Patent: Dec. 4, 2018

(54) ACTIVE NOISE CANCELLATION DEVICE

(71) Applicant: Huawei Technologies Co., Ltd., Shenzhen (CN)

(72) Inventors: Victor Dzhigan, Moscow (RU); Alexey Petrovsky, Moscow (CN); Jingfan Qin, Shenzhen (CN); Yang Song, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/381,768

(22) Filed: Dec. 16, 2016

(65) Prior Publication Data

US 2017/0125006 A1 May 4, 2017

Related U.S. Application Data

(63) Continuation of application No. PCT/RU2015/000295, filed on May 8, 2015.

(51) Int. Cl.
*G10K 11/178* (2006.01)
*H04R 1/10* (2006.01)

(52) U.S. Cl.
CPC ..... *G10K 11/178* (2013.01); *G10K 11/17854* (2018.01); *G10K 11/17881* (2018.01); (Continued)

(58) Field of Classification Search
CPC ..... G10K 2210/1081; G10K 11/16; G10K 11/178; G10K 11/1784; G10K 2210/3023; G10K 2210/30231; G10K 2210/3026; G10K 2210/3027; G10K 2210/3028; G10K 2210/3045; G10K 2210/3046; G10K 2210/3047; G10K 11/17881; G10K 11/17854; G10K 2210/3022; (Continued)

(56) References Cited

U.S. PATENT DOCUMENTS 5,991,418 A * 11/1999 Kuo ..... G10K 11/1784 381/71.11
8,515,089 B2 8/2013 Nicholson
(Continued)

OTHER PUBLICATIONS

Elliot, S.J., et al. "Active Noise Control," IEEE Signal Processing Magazine, vol. 10, No. 4, Oct. 1993, pp. 12-35.
(Continued)

*Primary Examiner* — Yogeshkumar Patel
(74) *Attorney, Agent, or Firm* — Conley Rose, P.C.

(57) ABSTRACT

An active noise cancellation device for cancelling a primary acoustic path between a noise source and a microphone by an overlying secondary acoustic path between a canceling loudspeaker and the microphone, the device comprising: a first input for receiving a microphone signal from the microphone; wherein the first electrical compensation path and the second electrical compensation path are coupled in parallel between a first node and the first input to provide the first noise canceling signal for a feed-backward prediction of the noise source; wherein the third electrical compensation path and the fourth electrical compensation path are coupled in parallel between a second node and the first input to provide the second noise canceling signal for a feed-forward prediction of noise source.

17 Claims, 25 Drawing Sheets

(52) U.S. Cl.
CPC ..... *G10K 2210/1081* (2013.01); *G10K 2210/3022* (2013.01); *G10K 2210/3026* (2013.01); *G10K 2210/3027* (2013.01); *G10K 2210/3028* (2013.01); *G10K 2210/3045* (2013.01); *G10K 2210/3047* (2013.01); *G10K 2210/30231* (2013.01); *H04R 1/1083* (2013.01)

(58) Field of Classification Search
CPC .. H04R 1/1083; H04R 3/002; H04R 2460/01; H04R 2410/05; H04R 2410/01; G10L 21/0208; G10L 21/0216
USPC ..... 381/71.1, 71.11, 317, 71.8; 455/570, 455/63.1; 704/E15.039, 233
See application file for complete search history.

(56) References Cited

U.S. PATENT DOCUMENTS

2010/0014685 A1* 1/2010 Wurm ..... G10K 11/178 381/71.11
2012/0170766 A1* 7/2012 Alves ..... G10K 11/178 381/71.11
2013/0129108 A1* 5/2013 Wurm ..... G10K 11/16 381/71.11
2014/0126736 A1* 5/2014 Gauger, Jr. ..... G10K 11/178 381/71.6
2014/0307888 A1* 10/2014 Alderson ..... H04R 3/002 381/71.8
2015/0310846 A1* 10/2015 Andersen ..... B05B 7/0884 381/71.6

OTHER PUBLICATIONS

Kuo, S.M., et al., "Active Noise Control: A Tutorial Review," Proceedings of the IEEE, vol. 87, No. 6, Jun. 1999, pp. 943-973.
Akhtar, M., et al., "Application of Adaptive Filtering: Resent Advancements in Active Noise Control," Adaptive Filtering Applications, Chapter 2, Jun. 2011, pp. 21-48.
Sayed, A., et al., "Fundamentals of Adaptive Filtering" John Wiley and Sons, Aug. 2005, pp. 77-79.
Diniz, P., "Adaptive Filtering Algorithms and Practical Implementation," Second Edition, 2012, 636 pages.
Farhang-Boroujeny, B., "Adaptive Filters Theory and Applications," 2nd Edition, 2013, 802 pages.
Desai, N., "Active Noise Cancellation by the modified Filtered X-LMS algorithm with online secondary path modeling," International Journal of Engineering Decelopment and Research, Jan. 17-18, 2014, 4 pages.
Douglas, S., et al., "An Efficient Implementation of the Modified Filtered-X LMS Algorithm," IEEE Signal Processing Letters, vol. 4, No. 10, Oct. 1997, pp. 286-288.
Akhtar, M., et al., "Modified-Filtered-x LMS Algorithm Based Active Noise Control Systems with Improved Online Secondary-Path Modeling," 47th IEEE International Midwest Symposium on Circuits and Systems, 2004, pp. I-13-I-16.
Bouchard, M., et al., "Multichannel Recursive-Least-Squares Algorithms and Fast-Trasversal-Filter Algorithms for Active Noise Control and Sound Reproduction System," IEEE Transactions on Speech and Audio Processing, vol. 8, No. 5, Sep. 2000, pp. 606-618.
Allen, J., et al., "Image method for efficiently simulation small-room acoustics," Journal of Acoustical Society of America, vol. 65, No. 4, Apr. 1979, pp. 943-950.
Kuo, S., et al., "Active Noise Control: A Tutorial Review," XP011044219, Proceedings of the IEEE, vol. 87, No. 6, Jun. 1999, pp. 943-973.
Lopez-Gaudana, E., et al., "A Hybrid Active Noise Cancelling with Secondary Path Modeling," XP031315221, Aug. 2008, pp. 277-280.
Foreign Communication From a Counterpart Application, PCT Application No. PCT/RU2015/000295, International Search Report dated Feb. 11, 2016, 8 pages.

* cited by examiner

ACTIVE NOISE CANCELLATION DEVICE

CROSS-REFERENCE TO RELATED APPLICATIONS

This application is a continuation application of international patent application number PCT/RU2015/000295 filed on May 8, 2015, which is incorporated by reference.

TECHNICAL FIELD

The present disclosure relates to an active noise cancellation device, in particular to active noise control systems using feed-forward, feed-backward and hybrid noise control as well as far-end signal compensation techniques. The disclosure further relates to methods of active noise control.

BACKGROUND

Acoustic noise cancellation problems arise in a number of industrial applications; in medical equipment like magnetic resonance imaging; in air ducts; in high quality headsets, headphones, handset etc., where it is required to reduce a background noise in a location of a listener. As the noise arises, propagates and exists in air, i.e. in acoustic environment, the noise can be cancelled or attenuated in acoustical way only. This problem is usually solved by Active Noise Control (ANC) systems. The ANC system produces anti-noise, i.e. acoustic wave, with the same amplitude and opposite phase as those of the cancelling noise in a plane of the cancellation. The principle of a sine wave noise 11 cancellation by anti-noise 12 is illustrated by the graph 10 shown in FIGS. 1*a*, 1*b* and 1*c*.

If noise 11 and anti-noise 12 have the same amplitude and opposite phase, then a perfect cancellation of the noise is achieved as shown in FIG. 1*a*. If there is amplitude (see FIG. 1*b*) or phase (see FIG. 1*c*) mismatch, then a partial cancellation, i.e. attenuation, of the noise is achieved only. Here 13 is residual (cancelled or attenuated) noise. The ANC systems are the systems, which can adjust the above mismatch during operation with respect to mismatch minimization.

As the performance of an ANC system depends on its architecture and used algorithms, there is a need to improve active noise cancellation.

In order to describe the disclosure in detail, the following terms, abbreviations and notations will be used:

ANC: active noise control, active noise cancellation
AP: affine projection
DAC: digital-to-analog converter
dB: decibel(s)
FB: feed-backward
FF: feed-forward
FAP: fast AP
GASS: gradient adaptive step size
Hybrid: combination of FB and FF
LMS: least mean squares
NLMS: normalized LMS
PSD: power spectral density
RLS: recursive least squares
WGN: white Gaussian noise.

SUMMARY

It is the object of the disclosure to provide a concept for improving active noise cancellation.

This object is achieved by the features of the independent claims. Further implementation forms are apparent from the dependent claims, the description and the figures.

The disclosure solves the above mentioned problems by applying one or more of the following techniques: Modification of the FB 30 and Hybrid 40 ANC systems, see FIGS. 3 and 4, providing the same input signal to the Adaptive Filter and the filter Adaptive Algorithm. Application in the FB 30 and Hybrid 40 ANC systems, see FIGS. 3 and 4, a circuit for the subtraction of the far-end signal from the signals, received by error microphone 103. Using the circuit for the subtraction of the far-end signal from the signals, received by error microphone 103, in the Modified FF, FB and Hybrid ANC systems based on a modification (denoted hereinafter as Filtered X modification) as described below.

The disclosure has the following advantages: Using the above-mentioned Filtered X modification allows estimation the maximal step-size value $\mu_{max}$ as defined in equation (22) of the gradient search based Adaptive Algorithms in the Modified FB and Hybrid ANC systems. In the case the step-size increases, that leads to the acceleration of the adaptation. Using the above mentioned Filtered X modification makes the RLS algorithms stable in the FB and Hybrid ANC systems. Using the circuit for the far-end signal subtraction from the signals in the FB and Hybrid ANC systems allows for the systems to operate during the far-end sound reproduction in the high quality headsets, headphones, handset etc. Using both, the above mentioned Filtered X modification and the circuit for the far-end signal subtraction from the signals in the FF, FB and Hybrid ANC systems with far-end signals allows for the systems to operate during the far-end sound reproduction.

According to a first aspect, the disclosure relates to an active noise cancellation device for cancelling a primary acoustic path between a noise source and a microphone by an overlying secondary acoustic path between a canceling loudspeaker and the microphone, the device comprising: a first input for receiving a microphone signal from the microphone; a first output for providing a first noise canceling signal to the canceling loudspeaker, a first electrical compensation path; and a second electrical compensation path, wherein the first electrical compensation path and the second electrical compensation path are coupled in parallel between a first node and the first input to provide the first noise canceling signal, the first node providing a prediction of the noise source.

The active noise cancellation device provides a flexible configuration that can be used for both cases, when it is possible to install a reference microphone nearby a noise source and when it is not possible to install such reference microphone. Due to the first and second compensation paths, the device provides an improved active noise cancellation.

In a first possible implementation form of the device according to the first aspect, the first electrical compensation path and the second electrical compensation path are coupled by a third subtraction unit to the first input.

This provides the advantage that both compensation signals from the first electrical compensation path and the second electrical compensation path contribute to the compensation, thereby improving the efficiency of noise compensation.

In a second possible implementation form of the device according to the first aspect, the device further comprises a second output for providing a second noise canceling signal to the canceling loudspeaker; a third electrical compensation path; and a fourth electrical compensation path, wherein the third electrical compensation path and the fourth electrical compensation path are coupled in parallel between a second node and the first input, the second node providing a feed-forward prediction of the noise source and the first node providing a feed-backward prediction of the noise source.

Such a device provides the advantage that both, feed-forward prediction and feed-backward prediction of the noise can be applied to improve the noise compensation.

In a third possible implementation form of the device according to the second implementation form of the first aspect, the third electrical compensation path and the fourth electrical compensation path are coupled by the third subtraction unit to the first input.

This provides the advantage that all four compensation signals from the first electrical compensation path, the second electrical compensation path, the third electrical compensation path and the fourth electrical compensation path, i.e. compensation from feed-forward as well as feed-backward compensation circuits contribute to the compensation, thereby improving the efficiency of noise compensation.

In a fourth possible implementation form of the device according to the second implementation form or the third implementation form of the first aspect, the device further comprises a delay element coupled between the first input and the first node for providing the feed-backward prediction of the noise source.

This provides the advantage that a delay element is simple to implement and may provide a realization for a feed-backward prediction of the noise source.

In a fifth possible implementation form of the device according to the first aspect as such or according to any of the preceding implementation forms of the first aspect, the first electrical compensation path comprises a first reproduction filter cascaded with a first adaptive filter, the first reproduction filter reproducing an electrical estimate of the secondary acoustic path.

This provides the advantage that by using such a cascade, the total length of the compensation filter, i.e. the first adaptive filter, can be reduced by the length of the first reproduction filter. This facilitates implementation of the adaptive filter because stability of adaptation methods is improved due to a shorter filter length. The first reproduction filter can be advantageously estimated off-line.

In a sixth possible implementation form of the device according to the fifth implementation form of the first aspect, the second electrical compensation path comprises a replica of the first adaptive filter cascaded with a second reproduction filter reproducing the electrical estimate of the secondary acoustic path.

This provides the advantage that by using such cascade the replica of the first adaptive filter has the same behavior as the first adaptive filter. The total length of the filter path can be reduced by the length of the second reproduction filter that has the same length as the first reproduction filter. Therefore, both first electrical compensation path and second electrical compensation path show identical behavior. The second reproduction filter can be advantageously estimated off-line.

In a seventh possible implementation form of the device according to the sixth implementation form of the first aspect, a first tap between the replica of the first adaptive filter and the second reproduction filter is coupled to the first output.

This provides the advantage, that the second reproduction filter can reproduce the behavior of the second acoustic path and hence the replica of the first adaptive filter can have a less number of coefficients making the adaptation more stable and fast.

In an eighth possible implementation form of the device according to any one of the fourth to the seventh implementation forms of the first aspect, the device further comprises a third input for receiving a far-end speaker signal, wherein the third input is coupled together with at least one of the first output and the second output to the canceling loudspeaker; a fifth reproduction filter coupled between the third input and an error input of the first adaptation circuit, the fifth reproduction filter reproducing an electrical estimate of the secondary acoustic path; and a sixth reproduction filter coupled between the first output and the first input, the sixth reproduction filter reproducing an electrical estimate of the secondary acoustic path.

This provides the advantage, that the device can efficiently compensate noise even in the presence of a far-end speaker signal without disturbing the far-end speaker signal.

In a ninth possible implementation form of the device according to the eighth implementation form of the first aspect, the device further comprises a second subtraction unit configured to subtract an output of the fifth reproduction filter from one of the microphone signal or third subtraction unit output to provide an error signal to the first adaptation circuit and second adaptation circuit; a first subtraction unit configured to subtract an output of the sixth reproduction filter from the microphone signal or from an output of the third subtraction unit to provide a compensation signal to the delay element; and a third output for outputting the compensation signal as far-end speech with noise.

This provides the advantage, that the device can efficiently compensate noise even in the presence of a far-end speaker signal without disturbing the far-end speaker signal.

In a tenth possible implementation form of the device according to any one of the second to the ninth implementation forms of the first aspect, the third electrical compensation path comprises a third reproduction filter cascaded with a second adaptive filter, the third reproduction filter reproducing an electrical estimate of the secondary acoustic path.

This provides the advantage that by using such a cascade, the total length of the compensation filter, i.e. the second adaptive filter, can be reduced by the length of the third reproduction filter. This facilitates implementation of the second adaptive filter because stability of recursive adaptation methods is improved due to a shorter filter length. The third reproduction filter can be advantageously estimated off-line.

In an eleventh possible implementation form of the device according to the tenth implementation form of the first aspect, the fourth electrical compensation path comprises a replica of the second adaptive filter cascaded with a fourth reproduction filter reproducing the electrical estimate of the secondary acoustic path.

This provides the advantage that by using such cascade the replica of the second adaptive filter has the same behavior as the second adaptive filter. The total length of the filter path can be reduced by the length of the fourth reproduction filter that has the same length as the second acoustic path. Therefore, both first electrical compensation path and second electrical compensation path show identical behavior. The fourth reproduction filter can be advantageously estimated off-line.

In a twelfth possible implementation form of the device according to the eleventh implementation form of the first aspect, a second tap between the replica of the second adaptive filter and the fourth reproduction filter is coupled to the second output.

This provides the advantage, that the fourth reproduction filter can reproduce the behavior of the second acoustic path and hence the replica of the second adaptive filter can have a less number of coefficients making the adaptation more stable and fast.

In a thirteenth possible implementation form of the device according to any one of the tenth to the twelfth implementation forms of the first aspect, the device comprises a first adaptation circuit configured to adjust filter weights of the first adaptive filter, wherein the first reproduction filter is cascaded with the first adaptation circuit.

Such first adaptation circuit can adjust filters having a reduced number of coefficients. Hence recursive algorithms like RLS can be applied showing faster convergence and better tracking properties without becoming unstable due to the reduced number of coefficients.

In a fourteenth possible implementation form of the device according to the thirteenth implementation form of the first aspect, the device comprises a second adaptation circuit configured to adjust filter weights of the second adaptive filter, wherein the third reproduction filter is cascaded with the second adaptation circuit.

Such second adaptation circuit can adjust filters having a reduced number of coefficients. Hence recursive algorithms like RLS can be applied showing faster convergence and better tracking properties without becoming unstable due to the reduced number of coefficients. Such a device provides the advantage that a far-end speaker signal can be easily coupled in without disturbing the adjustment of both the feed-backward compensation filter and the feed-forward compensation filter.

BRIEF DESCRIPTION OF THE DRAWINGS

Further embodiments of the disclosure will be described with respect to the following figures, in which.

DETAILED DESCRIPTION OF EMBODIMENTS

In the following detailed description, reference is made to the accompanying drawings, which form a part thereof, and in which is shown by way of illustration specific aspects in which the disclosure may be practiced. It is understood that other aspects may be utilized and structural or logical changes may be made without departing from the scope of the present disclosure. The following detailed description, therefore, is not to be taken in a limiting sense, and the scope of the present disclosure is defined by the appended claims.

It is understood that comments made in connection with a described method may also hold true for a corresponding device or system configured to perform the method and vice versa. For example, if a specific method step is described, a corresponding device may include a unit to perform the described method step, even if such unit is not explicitly described or illustrated in the figures. Further, it is understood that the features of the various exemplary aspects described herein may be combined with each other, unless specifically noted otherwise.

The devices, methods and systems according to the disclosure are based on one or more of the following techniques that are described in the following: FF ANC, FB Active Noise Control and Hybrid Active Noise Control.

Presently there are 3 main kinds of ANC systems: FF, FB and Hybrid (the combination of FF and FB).

Figure 1:
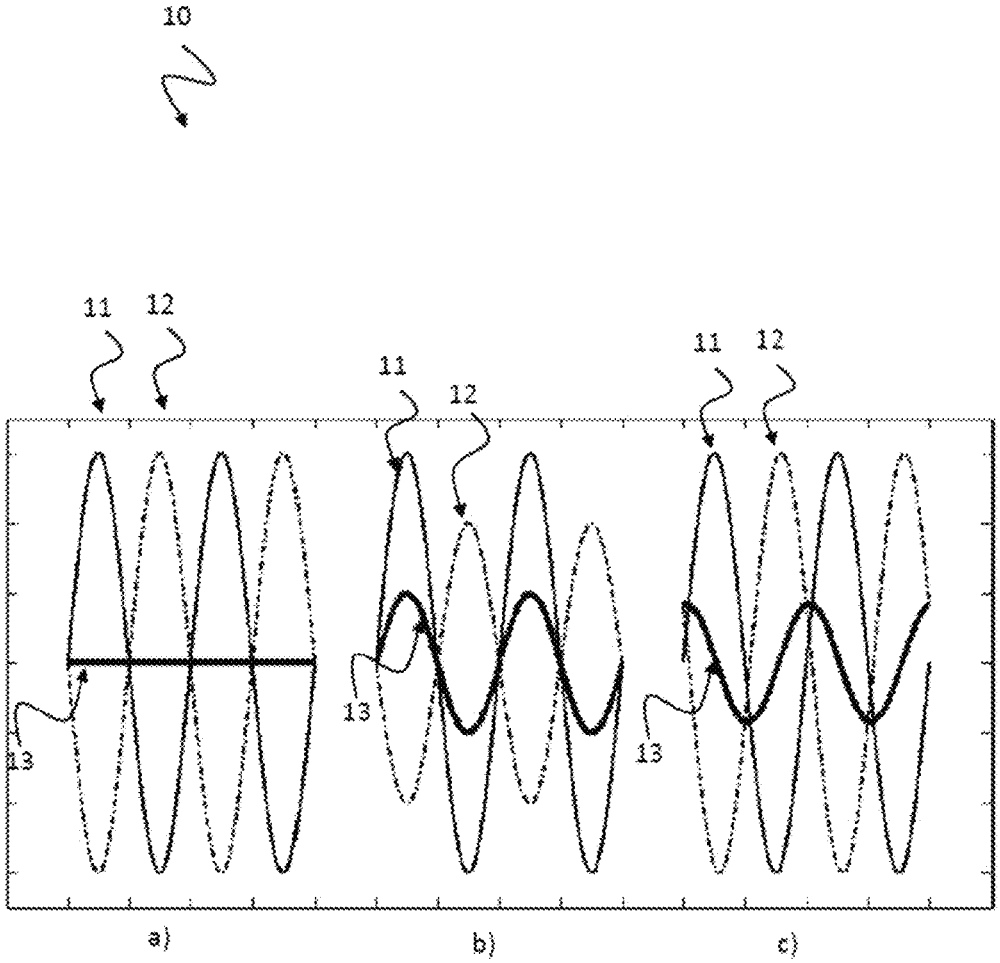
FIG. 1 shows a graph 10 illustrating the principle of a sine wave noise 11 cancellation by anti-noise 12.
Figure 2:
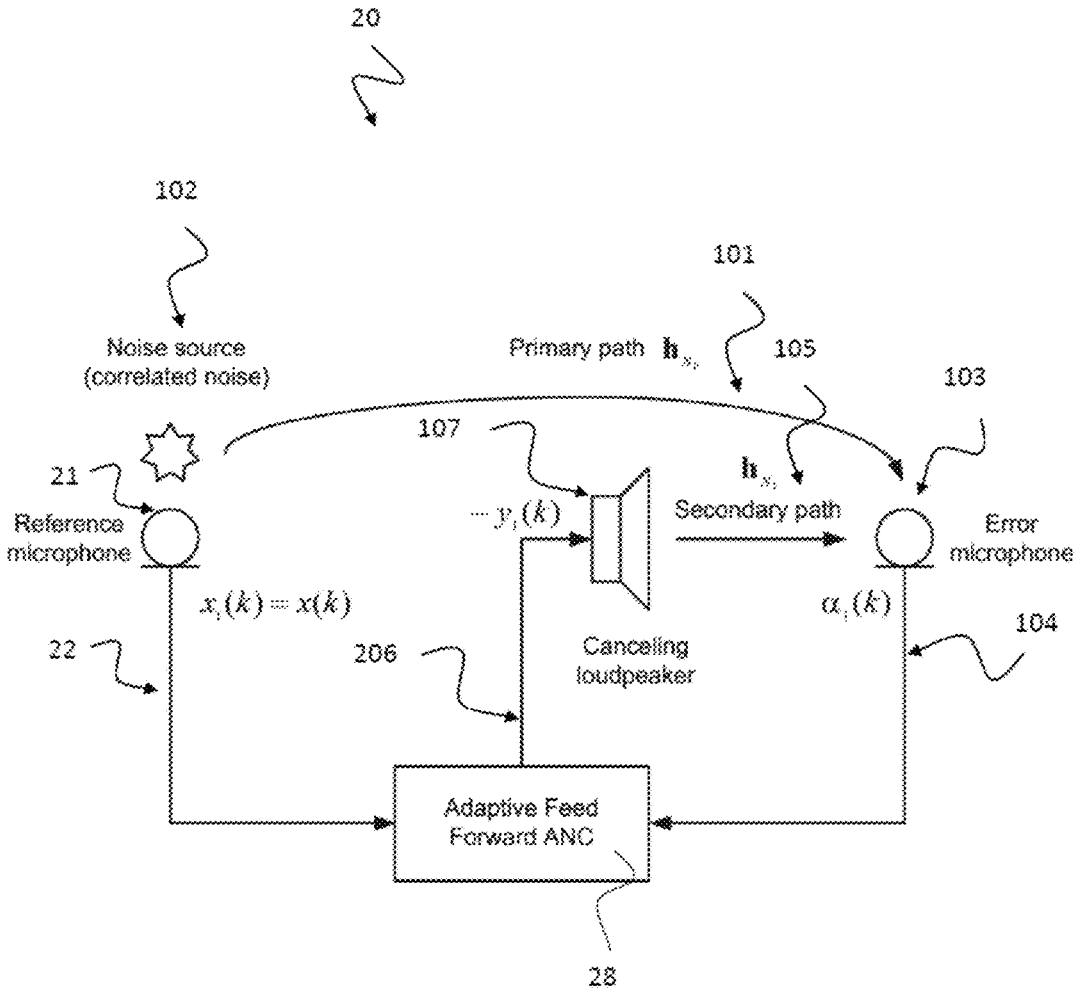
FIG. 2 shows a schematic diagram illustrating the principle of Feed-Forward Active Noise Control system 20.

The FF ANC system 20, see FIG. 2, is used in a case, when it is possible to install a reference microphone 21 nearby a noise source 102 or even in a place, where it is possible to evaluate noise, correlated with that of the noise source 102. Here and further, x(k) 22 is the noise signal, produced by a noise source 102. Even the signal exists in contiguous time t as x(t), for notation simplification we will use a discrete-time presentation of both continuous-time and discrete-time (i.e. time-sampled by Analog-to-Digital Converter, ADC) signals as x(k), where k=0, 1, 2 . . . is the signal sample number. The same discrete-time form is also used for other continues signals, described in the document. The discrete-time representation of continuous signals is useful for notations simplification and for computer simulation of ANC systems. In the case, the discrete time is defined as $t(k)=kT_S=k/F_S$, where $F_S$ is the sampling frequency and $T_S$ is the sampling frequency period.

The noise 22, received by the reference microphone 21, is $x_1(k)$. In the description, the lower index "1" indicates the signals, related to the FF ANC system architectures. Noise x(k), propagated via acoustic media, called primary path 101, to a location, where the noise has to be cancelled, produces the noise $h_{N_P}{}^T x_{N_P}(k)$. Here $$h_{N_P}=[h_{1,P},h_{2,P}, \ldots ,h_{N_P,P}]^T \tag{1}$$

is the vector of the primary path 101 impulse response samples, i.e. discrete model of the impulse response;

$$x_{N_P}(k)=[x(k),x(k-1), \ldots x(k-N_P+1)]^T \tag{2}$$

is the vector of the input signal of discrete filter $h_{N_P}$; $N_P$ is the number of the weights of the filter $h_{N_P}$. Upper index T denotes an operation of a vector transposition.

Error microphone 103 receives the combination of the above noise $h_{N_P}{}^T x_{N_P}(k)$ and the signal 206, $-y_1(k)$, eliminated via a loudspeaker 107 and propagated via acoustic media, called the secondary path 105. In cancellation plane (i.e. in location of error microphone), the signal 206, $-y_1(k)$, produces the signal $h_{N_S}{}^T[-y_{N_S}(k)]=-h_{N_S}{}^T y_{N_S}(k)$, called anti-noise, where $$h_{N_S}=[h_{1,S},h_{2,S}, \ldots ,h_{N_S,S}]^T \tag{3}$$

is the vector of the secondary path 105 impulse response samples, i.e., the discrete model of the impulse response;

$$y_{N_S}(k)=[y_1(k),y_1(k-1), \ldots ,y_1(k-N_S+1)]^T \tag{4}$$

is signal vector of the discrete filter $h_{N_S}$; $N_S$ is the number of weights of the $h_{N_S}$.

The cancelled noise, received by error microphone 103, is $$\alpha_1(k)=h_{N_P}{}^T x_{N_P}(k)-h_{N_S}{}^T y_{N_S}(k). \tag{5}$$

Signals $x_1(k)$ and $\alpha_1(k)$ are used by the FF ANC system 20 to generate the anti-noise, eliminated by the loudspeaker 107. Secondary path 105 filter is generally a convolution of the DAC, amplifier, loudspeaker 107 and secondary path acoustic impulse responses. The anti-noise is produced by the Adaptive Feed-forward ANC 28.

Figure 3:
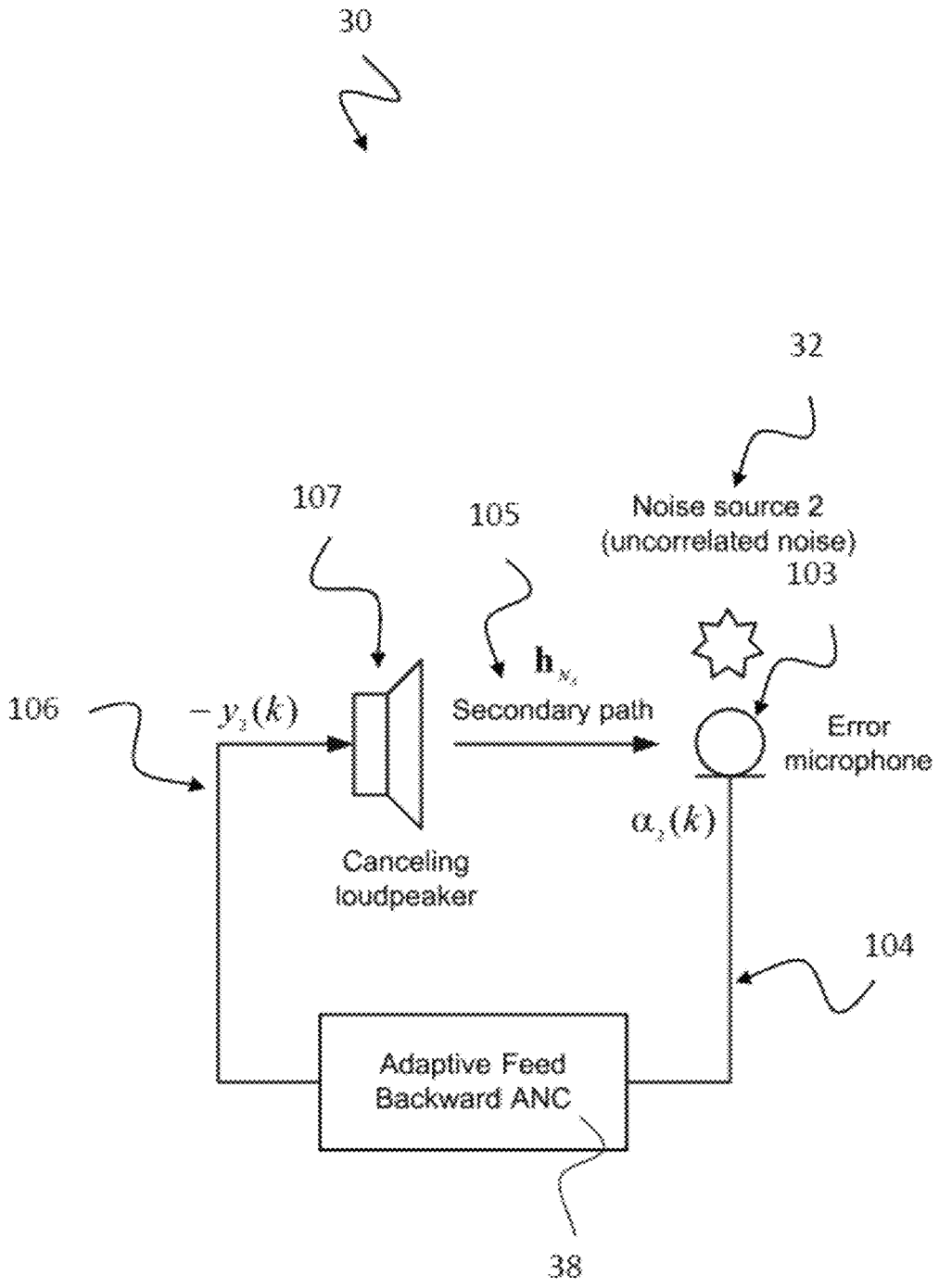
FIG. 3 shows a schematic diagram illustrating the principle of Feed-Backward Active Noise Control system 30.

The FB ANC system 30, see FIG. 3, is used in the case, when it is impossible to have a reference microphone, i.e. only one error microphone 103 receives noise 32, called uncorrelated. In the case the signal 106, $-y_2(k)$, is predicted from the signal 104, $\alpha_2(k)$, received by the error microphone 103. In the description, the lower index "2" indicates the signals, related to the FB ANC system 30 architectures.

The signal 106, $-y_2(k)$, is eliminated via a loudspeaker 107 and propagated via the secondary path 105. In cancellation plane (i.e. location of error microphone) the signal produces the anti-noise $h_{N_S}{}^T[-y_{N_S}(k)]=-h_{N_S}{}^T y_{N_S}(k)$, where $$y_{N_S}(k)=[y_2(k),y_2(k-1), \ldots ,y_2(k-N_S+1)]^T. \tag{6}$$

The anti-noise is produced by the Adaptive Feed-backward ANC 38.

Figure 4:
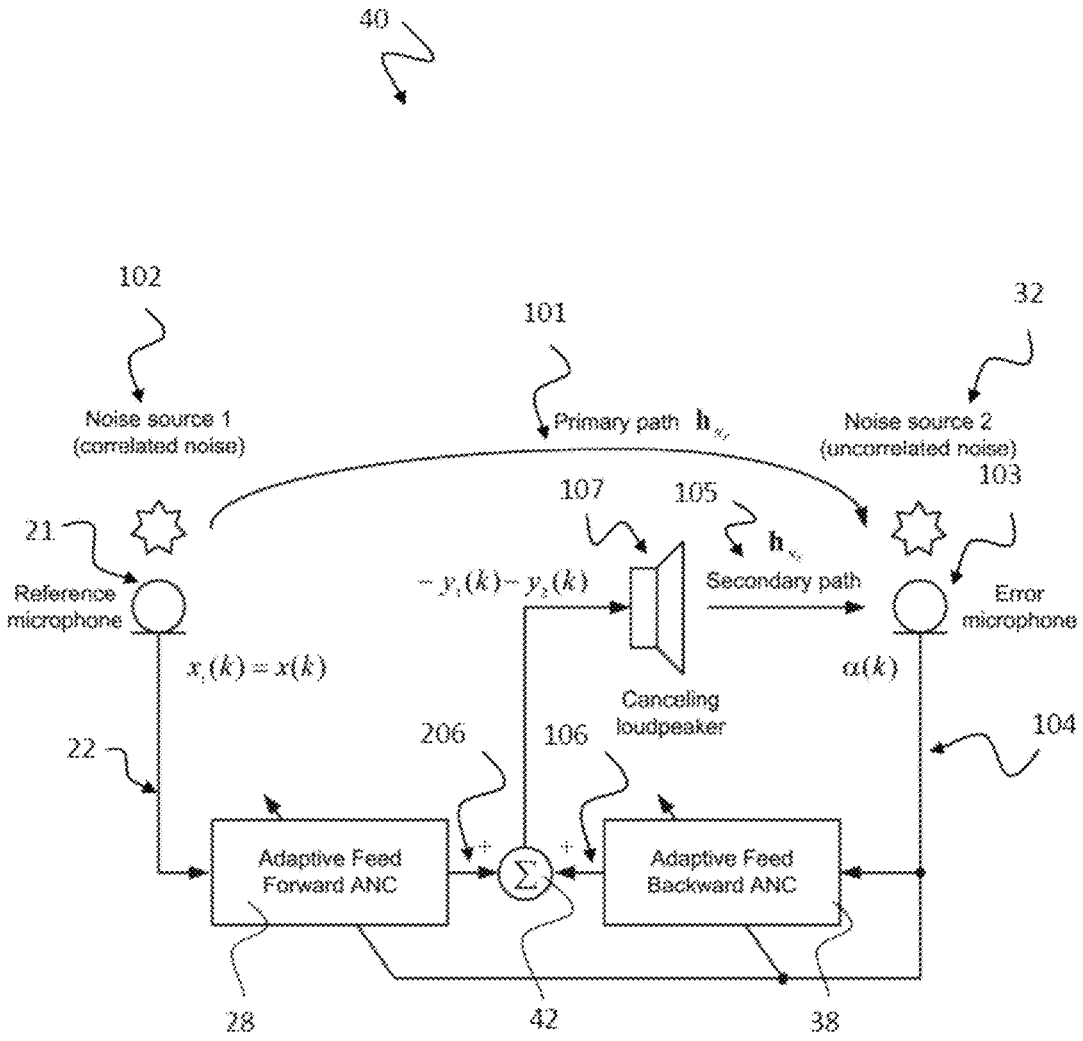
FIG. 4 shows a schematic diagram illustrating the principle of Hybrid Active Noise Control system 40.

The Hybrid ANC system 40, see FIG. 4, is used in the case, if there are two sorts of noise sources: correlated 102 and uncorrelated 32 ones. In the case the canceled noise is produced as the result of the simultaneous operation of the FF and FB ANC systems.

The FF, FB and Hybrid ANC systems use the adaptive filters 28, 38 for cancelled noise estimation and anti-noise generation. The anti-noise is produced by a combination of the Adaptive Feed-Backward ANC 38 and the Adaptive Feed-Forward ANC 28 which output signals 106, 206 are added by an addition unit 42 and provided to the cancelling loudspeaker 107.

In the following description and visualization in the figures, for the adaptive filters the filtering part, called Adaptive Filter, and the Adaptive Algorithm, which calculates the Adaptive Filter weights, are separated for a better representation. It is because some of the ANC architectures use two filters (Adaptive Filter and Adaptive Filter Copy) with the same weights, computed by the Adaptive Algorithm, but with different input signals.

Hereinafter, the filters of the primary $h_{N_P}$ path 101 and of the secondary $h_{N_S}$ path 105 are represented by dotted boxes that are different from the solid lines boxes representing the filters with the weight vector $h_{N_S'}$, that are the estimate of the impulse response of the secondary path 105. Generally, $N_{S'} \leq N_S$ and $h_{N_S} \approx h_{N_S'}|_{for\ n=1,2,\ldots,N_{S'}}$.

Figure 5:
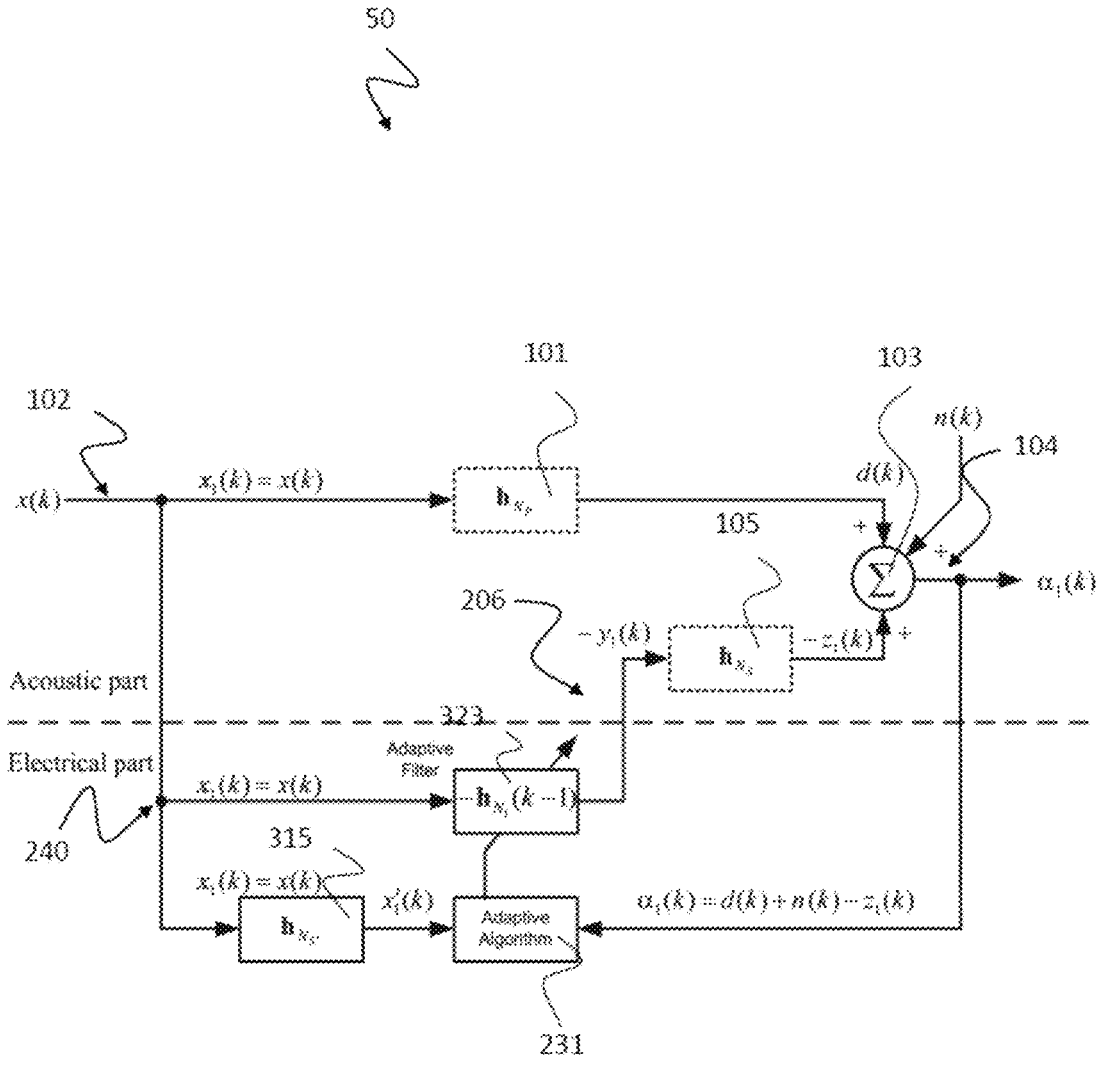
FIG. 5 shows a block diagram illustrating the Feed-Forward Active Noise Control system architecture 50.

The details of the FF ANC system 20, see FIG. 2, are shown in FIG. 5 illustrating the Feed-Forward Active Noise Control system architecture 50.

To get a perfect cancellation of the noise $$d(k)=h_{N_P}{}^T x_{N_P}(k), \tag{7}$$

produced by the signal of the noise source x(k) 102, the signal $z_1(k)$ in the plane of reference microphone has to satisfy the conditions $$z_1(k)\approx -d(k). \tag{8}$$

Signal $z_1(k)$ is the result of the filtering of the signal $x(k)=x_1(k)$ by a filter with the weights, that are the convolution of $h_{N_1}(k-1)$ and $h_{N_S}$ vectors, where $h_{N_1}(k-1)$ is the weights vector of the Adaptive Filter, computed by the Adaptive Algorithm at the previous iteration (k−1). It is assumed, that the iterations and signal samples have the same duration.

An adaptive filter consists of the filtering part 323, that performs the operation $h_{N_1}{}^T(k-1)x_{N_1}(k)$, and an Adaptive Algorithm 231, that computes the filter weights $h_{N_1}{}^T(k-1)$ in an ANC system. The adaptive filter solves the problem of the identification of discrete model $h_{N_P}$ of the primary path 101. The identification is provided by a cascade of $h_{N_1}(k-1)$ and $h_{N_S}$ filters 313, 315.

In the case, the input signal vector of the total filter consists of the signal vectors of the both filters. That is, the signal vector that is used in the Adaptive Algorithm, has to be extended with a vector $$x_{N_S}(k)=[x_1(k),x_1(k-1), \ldots ,x_1(k-N_S+1)]^T. \tag{9}$$

However, as $N_S$ is not known exactly, the vector $$x_{N_{S'}}(k)=[x_1(k),x_1(k-1), \ldots ,x_1(k-N_{S'}+1)]^T, \tag{10}$$

is used instead of (9).

The vector $h_{N_{S'}}$ is the vector of the weights that are the samples of the estimated impulse response of the secondary path 105. The filter weights $h_{N_{S'}}$ are estimated by a diversity of on-line or off-line methods that are standard procedures in the ANC systems. The procedures are outside the subjects of the given disclosure and are not considered in this disclosure.

In the FF ANC architecture 50, see FIG. 5, the anti-noise signal is produced as $$-z_1(k)=h_{N_S}^T[-y_{N_S}(k)]=-h_{N_S}^T y_{N_S}(k). \quad (11)$$

The error signal, received by the error microphone, $$\alpha_1(k)=d(k)+n(k)-z_1(k) \quad (12)$$

also contains the additive noise n(k), that is uncorrelated with primary noise x(k). The noise n(k) can include uncorrelated acoustic noise in the FF ANC system and other uncorrelated noise that is produced by the DAC and loudspeaker amplifier in secondary path 105, and by the amplifier and ADC in error microphone branch in any of FF, FB and Hybrid ANC systems.

For Adaptive Filter weights calculation the architecture of the FF ANC system 50, see FIG. 5, can use any of Adaptive Algorithms, based on gradient search: LMS, GASS LMS, NLMS, GASS NLMS, AP, GASS AP, FAP or GASS FAP, e.g. as described, for example, in Ali H. Sayed, "Fundamentals of Adaptive Filtering," 2003 ("Sayed"); Paulo S. R. Diniz, "Adaptive Filtering: Algorithms and Practical Implementation," 2012 ("Diniz"); V. I. Dzhigan "Adaptive Filtering: Theory and Algorithms," 2013 ("Dzhigan"); Behrouz Farhang-Boroujeny, "Adaptive Filters: Theory and Applications," 2013 ("Farhang-Boroujeny"); and Simon O. Haykin, "Adaptive Filter Theory," 2013 ("Haykin"), which are incorporated by reference.

Due to the using of the filter $h_{N_{S'}}$ 315, see FIG. 5, the Adaptive Algorithms are called Filtered-X ones. It is because the input signal in adaptive filters of ANC systems, often denoted as x(k), is filtered by the filter $h_{N_{S'}}$ 315. In this case, a maximal step-size $\mu_{max}$ of the gradient search based Adaptive Algorithms, which guarantees the algorithm stability, is restricted as $$0<\mu_{max}<\frac{1}{3(N_1+N_{S'})\sigma_x^2}, \quad (13)$$

where $\sigma_x^2$ is the variance of the signal x(k).

Figure 6:
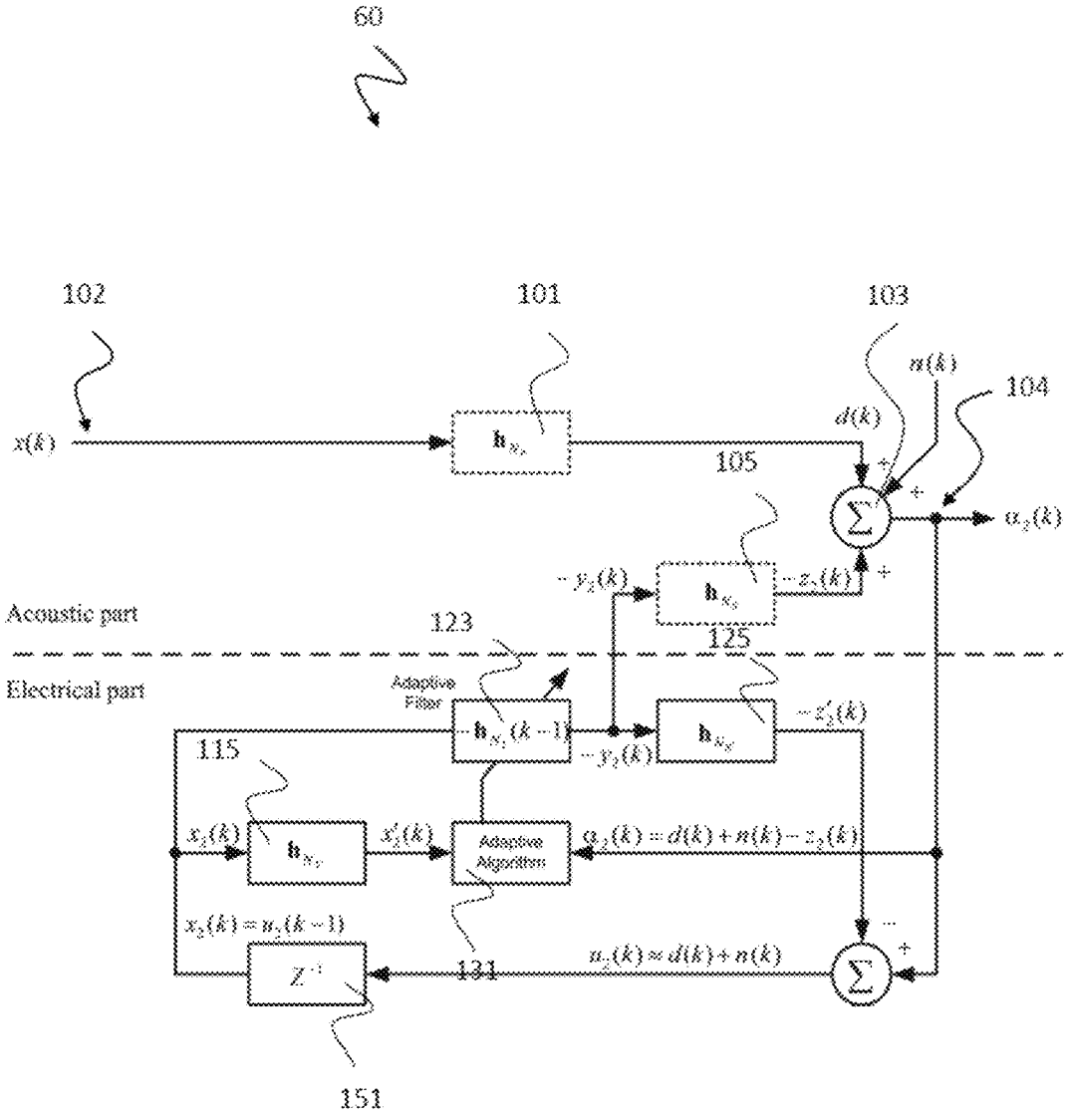
FIG. 6 shows a block diagram illustrating the Feed-Backward Active Noise Control system architecture 60.

The details of the FB ANC system 60, see FIG. 3, are shown in FIG. 6. The ANC system is used, when the noise d(k) as well as n(k) cannot be estimated by a reference microphone. In this case, the signal $x_2(k)=x(k)$ is predicted from the noisy signal d(k)+n(k). For that, using the signals $\alpha_2(k)$ and $z_2'(k)$, the estimate of the noisy signal d(k) is obtained as $$u_2(k)=\alpha_2(k)-[-z'_2(k)]=d(k)+n(k)-z_2(k)+z'_2(k)\approx d(k)+n(k), \quad (14)$$

where $$-z'_2(k)=-h_{N_{S'}}^T y_{N_{S'}}(k) \quad (15)$$

is the estimate of anti-noise signal $z_2(k)$ and $$y_{N_{S'}}(k)=[y_2(k),y_2(k-1),\ldots,y_2(k-N_S+1)]^T. \quad (16)$$

The signal $z_2(k)$ in the plane of reference microphone has to satisfy the conditions $z_2(k)\approx-d(k)$. Signal $z_2(k)$ is the result of the filtering of the signal $x_2(k)$ by a filter with the weights, that are the convolution of $h_{N_2}(k-1)$ vector 113 and $h_{N_S}$ vector 105, where $h_{N_2}(k-1)$ is the weights vector 123 of the Adaptive Filter, computed by the Adaptive Algorithm 131 at the previous iteration (k−1).

The FB ANC system input signal is the one-sample delayed signal $$x_2(k)=u_2(k-1). \quad (17)$$

A maximal step-size $\mu_{max}$ of the gradient search based Adaptive Algorithms, used in the FB ANC system 60, see FIG. 6, is the same as equation (13), where the number of Adaptive Filter weights $N_1$ is substituted by $N_2$.

Figure 7:
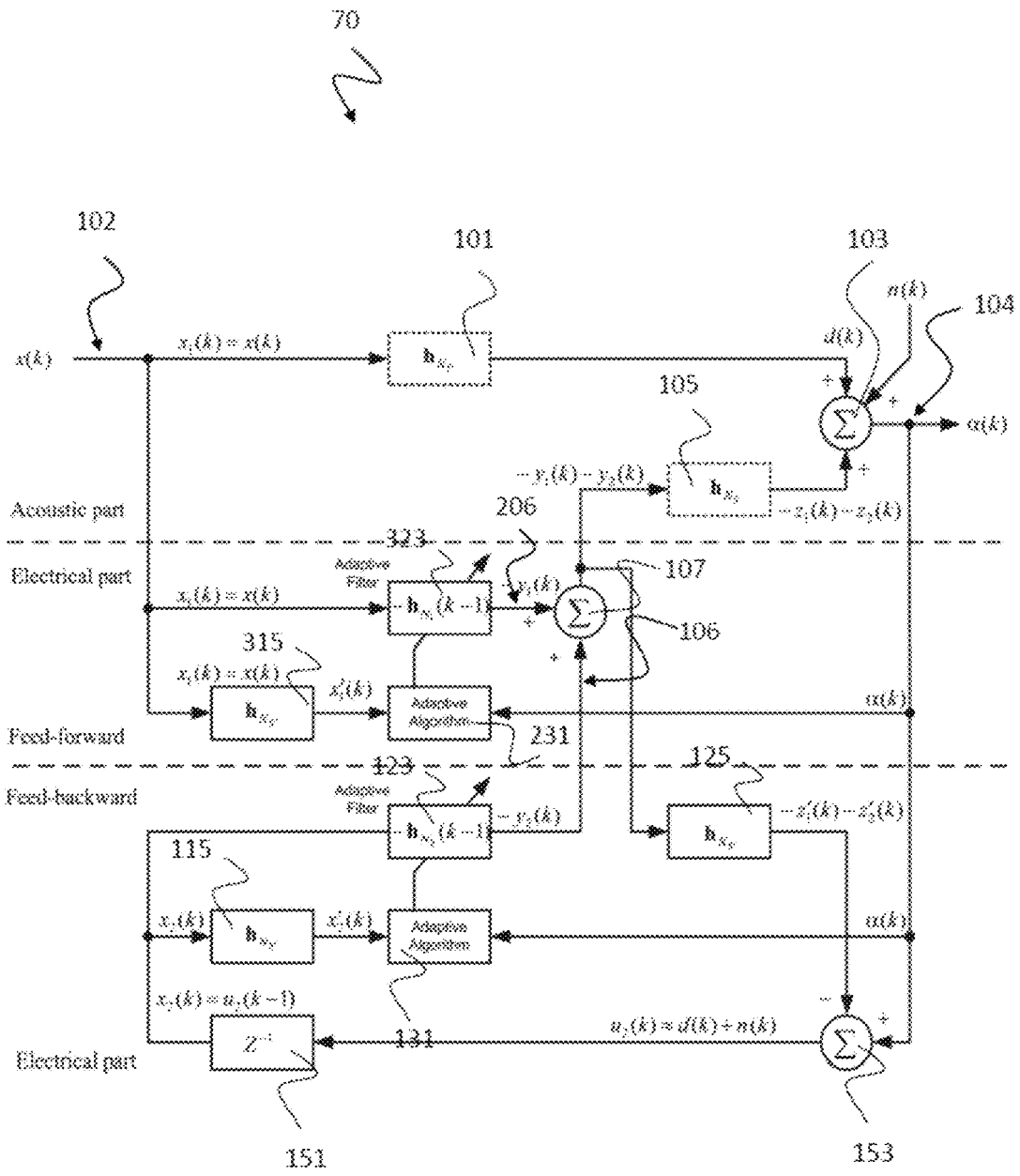
FIG. 7 shows a block diagram illustrating the Hybrid Active Noise Control system architecture 70.

The details of Hybrid, i.e. combined FF and FB, ANC system 70, see FIG. 4, are shown in FIG. 7. The system is used, when there are the d(k) noise, which can be estimated by a reference microphone, and the n(k) noise, which cannot be estimated by a reference microphone.

In the Hybrid ANC architecture, the anti-noise signal is produced as $$-z_1(k)-z_2(k)=h_{N_S}^T y_{N_S}(k), \quad (18)$$

where $$y_{N_S}(k)=[y_1(k)+y_2(k),y_1(k-1)+y_2(k-1),\ldots,y_1(k-N_S+1)+y_2(k-N_S+1)]^T. \quad (19)$$

The signal $-z'_1(k)-z'_2(k)$ is produced as $$-z'_1(k)-z'_2(k)=-h_{N_{S'}}^T(k-1)y_{N_{S'}}(k) \quad (20)$$

where $$y_{N_{S'}}(k)=[y_1(k)+y_2(k),y_1(k-1)+y_2(k-1),\ldots,y_1(k-N_{S'}+1)+y_2(k-N_{S'}+1)]^T. \quad (21)$$

A maximal step-size $\mu_{max}$ of the each of the two gradient search based Adaptive Algorithms 131, 231, used in the Hybrid ANC system 70, is defined in the same way as equation (13), where the numbers of Adaptive Filter weights are $N_1=N_2$.

Both Adaptive Filters 123, 323, used in used the Hybrid ANC system, can be viewed as a 2-channel adaptive filter.

The disclosure is based on the finding that techniques for improving active noise cancellation according to the disclosure solve the following three problems, which restrict the efficiency of ANC systems and its applications.

Problem 1: The step-size $\mu_{max}$, see equation (13), in gradient search based Adaptive Algorithms, used in the FF, FB and Hybrid ANC systems, see FIGS. 4-7, has to have a smaller value comparing with the case, when the both Adaptive Filter and Adaptive Algorithm use the same input signal x(k), i.e. comparing with the case $$0<\mu_{max}<\frac{1}{3N_1\sigma_x^2}, \quad (22)$$

where $N_1=N_2$ are the numbers of Adaptive Filter weights.

The value of step-size $\mu_{max}$, see equation (13) increases the duration of the transient process of an Adaptive Filter in use, because the time-constant of transient process of the gradient search based Adaptive Algorithms depends on the step-size value in the following way: time constant is decreased (transient process is decreased) if the step-size is increased.

Problem 2: Architectures of the FF, FB and Hybrid ANC systems, see FIGS. 4-7, cannot use the Recursive Least Squares (RLS) Adaptive Algorithms, which are more efficient ones comparing with the gradient search based Adaptive Algorithms, because the RLS algorithms become instable in these architectures, as they do not have a parameter (like a step-size) for the algorithm stability adjustment, caused by the length (number of weights) of the total filter (i.e. Adaptive Filter and secondary path convolution).

Figure 8:
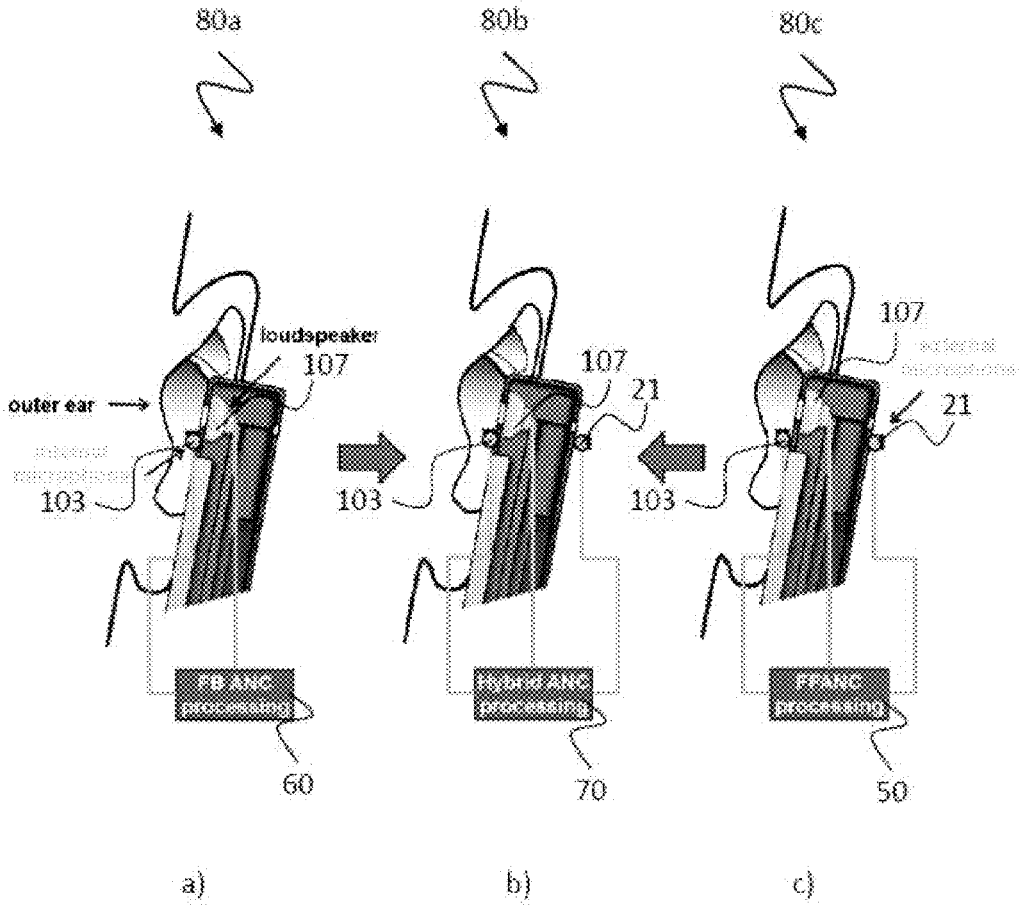
FIG. 8 shows a schematic diagrams illustrating application of FF, FB and Hybrid ANC system in a handset 80*a*, 80*b*, 80*c;*

Problem 3: In the high quality headsets, headphones, handset etc., there is only one loudspeaker, that has to be used not only for the reproducing of anti-noise, generated by an ANC system, but also for the reproducing of other sounds, like far-end speech or music, coming from the sound-record reproducing systems or networks. An example is shown in FIG. 8.

In the following, devices, systems and methods using the so called "Filtered X" modification are described.

The Filtered X modification of the FF ANC system is designed to provide the Adaptive Filter and the Adaptive Algorithm with the same Filtered-X signal, that is $$x'_1(k)=h_{N_S'}^T(k-1)x_{N_S}(k), \tag{23}$$

where $$x_{N_S}(k)=[x_1(k),x_1(k-1), \ldots ,x_1(k-N_S+1)]^T. \tag{24}$$

Figure 9:
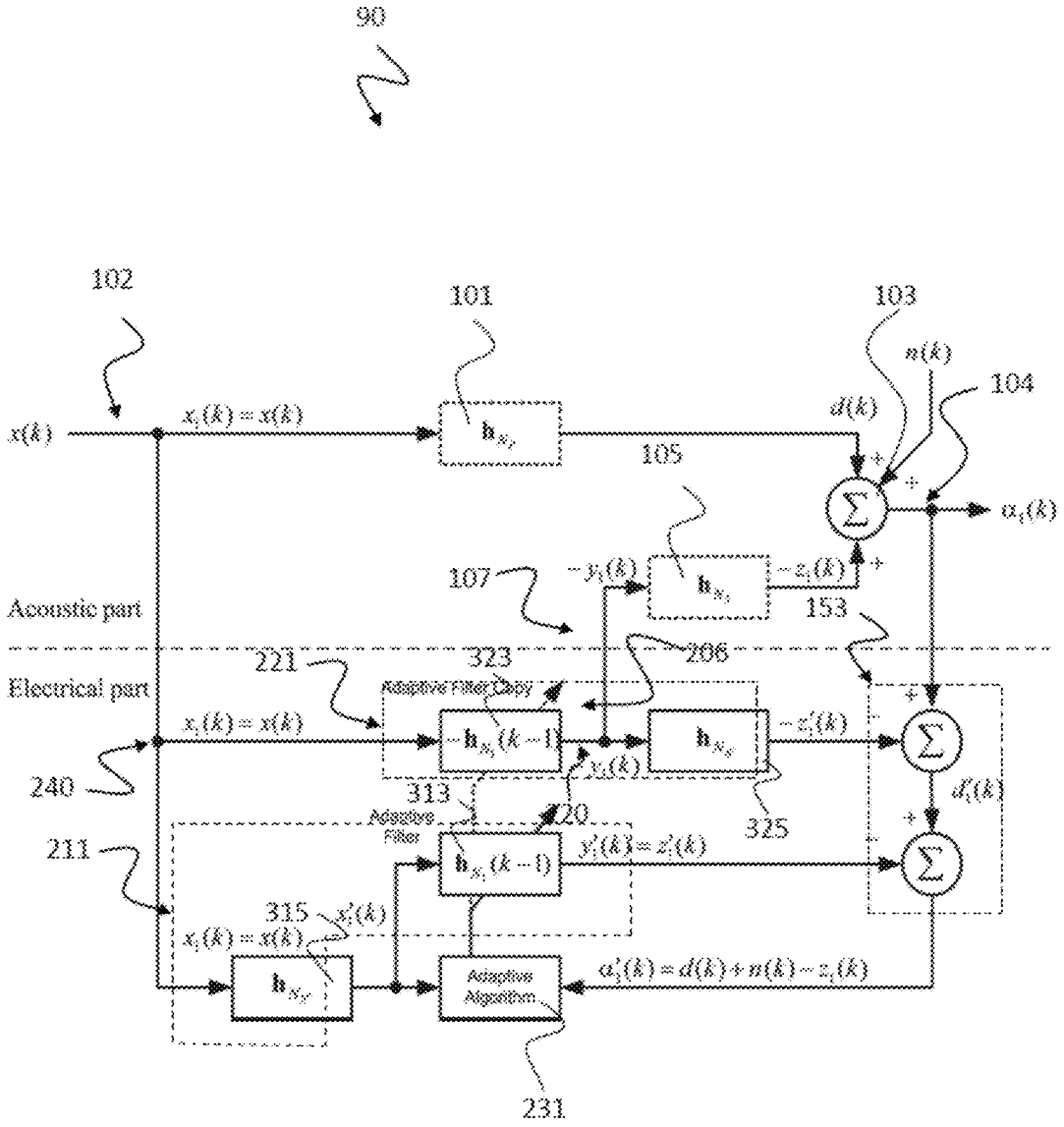
FIG. 9 shows a block diagram illustrating the Modified Feed-Forward Active Noise Control system 90.

The Modified FF ANC system 90 is shown in FIG. 9.

Opposite to the FF ANC system 50, see FIG. 5, where Adaptive Algorithm uses $\alpha_1(k)$ error signal, see equation (12), produced acoustically, in the Modified FF ANC system 90, see FIG. 9, the error signal for Adaptive Algorithm is produced electrically. It is done in two steps.

Step 1. From the error signal $\alpha_1(k)$, the noise signal d(k) in the plane of error microphone 103 is estimated as $$\begin{aligned} d'_1(k) &= d(k)+n(k)-z_1(k)-[-z'_1(k)] = \\ &= d(k)+n(k)-z_1(k)+z'_1(k) \\ &\approx d(k)+n(k). \end{aligned} \tag{25}$$

For that, the signal $-y_1(k)$, produced by the Adaptive Filter Copy 323 in the same way as in the FF ANC system 50, see FIG. 5, is filtered as $$-z'_1(k)=h_{N_S'}^T[-y_{N_S}(k)]=-h_{N_S'}^T y_{N_S}(k), \tag{26}$$

where $$y_{N_S}(k)=[y_2(k),y_2(k-1), \ldots ,y_2(k-N_S+1)]^T. \tag{27}$$

Step 2. The error signal for Adaptive Algorithm 231 is defined as $$\begin{aligned} \alpha'_1(k) &= d'_1(k)-y'_1(k) \\ &= d(k)+n(k)-z_1(k)+z'_1(k)-y'_1(k) = \\ &= d(k)+n(k)-z_1(k)+z'_1(k)-z'_1(k) \\ &= d(k)+n(k)-z_1(k) \\ &= \alpha_1(k), \end{aligned} \tag{28}$$

i.e. the error signal in the Modified FF ANC system 90, see FIG. 9, is the same as in the FF ANC system 50, see FIG. 5.

So, the acoustic noise compensation path in FIG. 9, i.e. cascade of Adaptive Filter Copy $-h_{N_S'}(k-1)$ 323 and the secondary path $h_{N_S}^T$ 105, is the same as that in FIG. 5; error signal $\alpha_1'(k)=\alpha_1(k)$ used by the Adaptive algorithms is also the same in the both cases. Besides, in case of the Modified FF ANC system 90, see FIG. 9, both Adaptive Algorithm 231 and Adaptive Filter 313 use the same input signal $x_1'(k)$, see equation (23). In that case, the step-size $\mu_{max}$ of an Adaptive Filter 313 can be estimated as in equation (22), because the Adaptive Filter 313 operates independently from the rest of FF ANC system parts, as the Adaptive Filter 313 and Adaptive Algorithm 231 processes the input signal $x_1'(k)$, see equation (23) and desired signal $d_1'$ (k), see equation (24).

This solution allows to estimate the maximal step-size value $\mu_{max}$ as in equation (22) for the gradient search based Adaptive Algorithms, used in Modified ANC system 90, see FIG. 9, as well as to use correctly the efficient RLS Adaptive Algorithms.

Figure 10:
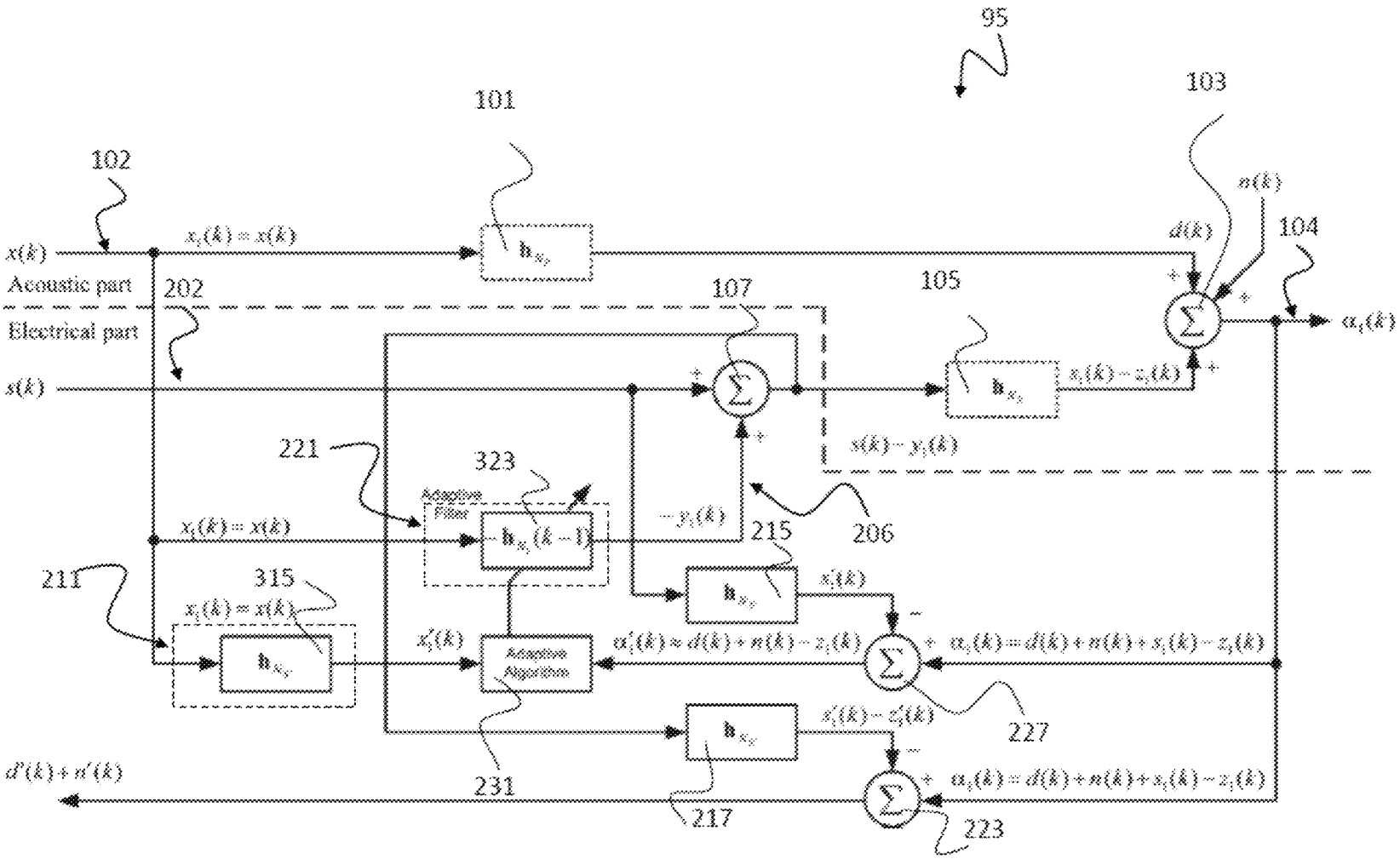
FIG. 10 shows a block diagram illustrating the Feed-Forward Active Noise Control system with far-end signal compensation 95.

If an ANC system 50, 60, 70 is used in the high quality headsets, headphones, handset etc., i.e. the devices similar to 80*a*, 80*b*, 80*c* with only one loudspeaker 107 as shown in FIGS. 8*a*, 8*b* and 8*c*, that has to be used not only for the reproducing of the anti-noise, generated by the ANC system, but also for the reproducing of other sounds $s_1(k)$ (far-end speech or music, coming from sound-reproducing systems or networks, see FIG. 10), a solution, that electrically subtracts the sounds from signal, received by error microphone has to be used. This solution is shown in FIG. 8. The device 80*a* depicted in FIG. 8*a* includes a loudspeaker 107 and an internal microphone 103. The compensation path using FB ANC processing 60 as described above with respect to FIG. 6 is between the internal microphone 103 and the loudspeaker 107. The device 80*b* depicted in FIG. 8*b* includes a loudspeaker 107, an internal microphone 103 and an external microphone 21. The compensation path using hybrid ANC processing 70 as described above with respect to FIG. 7 is between the internal microphone 103, the external microphone 21 and the loudspeaker 107. The device 80*c* depicted in FIG. 8*c* includes a loudspeaker 107, an internal microphone 103 and an external microphone 21. The compensation path using FF ANC processing 50 as described above with respect to FIG. 5 is between the internal microphone 103, the external microphone 21 and the loudspeaker 107.

In the FF ANC system, see FIG. 10, the far-end signal s(k) is mixed with the signal $-y_1'(k)$, produced by the Adaptive Filter 313 for the suppression of the noise d(k). Due to the mixing, these two signals $s_1(k)$ and $-z_1(k)$ are delivered to error microphone 103.

So, acoustically produced error signal $$\alpha_1(k)=d(k)+n(k)+s_1(k)-z_1(k) \tag{29}$$

contains the far-end signal s(k), acoustically filtered by secondary path 105 as $$s_1(k)=h_{N_S}^T s_{N_S}(k), \tag{30}$$

where $$s_{N_S}(k)=[s_1(k),s_1(k-1), \ldots ,s_1(k-N_S+1)]^T. \tag{31}$$

The signal $s_1(k)$ disturbs the adaptation process and even makes the adaptation impossible, because the signal is the high-level additive noise that is not modelled by the Adaptive Filter Copy 323.

The signal $$s'_1(k)=h_{N_S'}^T s_{N_S'}(k), \tag{32}$$

which is the estimate of the signal $s_1(k)$, where $$s_{N_S'}(k)=[s_1(k),s_1(k-1), \ldots ,s_1(k-N_S+1)]^T, \tag{33}$$

is subtracted from the error signal $\alpha_1(k)$, see equation (29). This produces the far-end signal free estimate of the ANC system error signal $$\alpha'_1(k)=\alpha_1(k)-s'_1(k)=d(k)+n(k)+s_1(k)-z_1(k)-s'_1(k)\approx d(k)+n(k)-z_1(k), \quad (34)$$

i.e., about the same error signal as that of the FF ANC 50, see FIG. 5 and equation (12).

This allows for the FF ANC system 95, see FIG. 10, to operate with the performance that is about the same as that of FF ANC System 50, see FIG. 5. The difference in the performance of the both systems can be defined by the measure how far away the secondary path $h_{N_{S'}}$ estimate 215 is from the actual secondary path $h_{N_S}$ 105. If the relationship $h_{N_{S'}}=h_{N_S}$ is not true, then the additive noise $s_1(k)-s_1'(k)$ is produced. The noise, similarly to the noise n(k), disturbs the ANC system performance. To minimize the noise $s_1(k)-s_1'(k)$, the secondary path $h_{N_{S'}}$ 105 has to be estimated carefully. This estimation also affects the whole performance of any ANC system, because a number of filters with weights vector $h_{N_{S'}}$ used in the ANC systems, see FIGS. 9 and 11-17.

The weights $h_{N_{S'}}$ 215 can be estimated by a diversity of on-line or off-line methods that are standard procedures in the ANC systems. The procedures are outside the subjects of the given disclosure and are not considered in this disclosure.

As the ANC system 95, see FIG. 10, operates, when the high quality headsets, headphones, handset and other similar devices are used by a listener, there is no need to use the ANC, when there is no noise, that has to be cancelled.

This "noise activity" can be detected, if to use the estimation of the signal d'(k)+n'(k). The estimation is produced by a circuit, shown in the bottom part of FIG. 10 (using the blocks 217, 223). The estimate is $$\begin{aligned}\alpha_1(k)-[s'_1(k)-z'_1(k)] &= d(k)+n(k)+s_1(k)-z_1(k)- \\ &\quad s'_1(k)-s'_1(k)+z'_1(k)\approx \\ &\approx d(k)+n(k) \\ &= d'(k)+n'(k).\end{aligned} \quad (35)$$

So, according to the disclosure, a number of solutions, presented in FIGS. 9 and 10, are presented to be used in the different modifications of the ANC systems as it is briefly described above with respect to FIGS. 9 and 10.

What is particularly important, the ANC operation, i.e. acoustic noise cancellation, has to be done during the far-end signal activity. As the signal is not the anti-noise, it will disturb the ANC system. The far-end signal has to be estimated and subtracted from the signals, received by the error microphone, prior to the sending to adaptive filters of the ANC system.

The technologies, described above, see FIGS. 9 and 10, applied to the FF, FB and Hybrid ANC system architectures, see FIGS. 5-7, produce seven new architectures of the ANC systems. The descriptions of the architectures are presented below.

The most general architecture is one of the Modified Hybrid ANC systems with far-end signal compensation, see FIG. 11 (*a,b,c*). The other six architectures, see FIGS. 12-17, can be viewed as the particular cases of the general architecture depicted in FIG. 11 (*a,b,c*).

The following reference signs are used in the description below with respect to FIGS. 11 to 17:

101: primary acoustic path
102: noise source
103: microphone
105: secondary acoustic path
107: canceling loudspeaker
104: first input
106: first output
111: first electrical compensation path
121: second electrical compensation path
140: first node
153: third subtraction unit
227: second subtraction unit
223: first subtraction unit
206: second output
211: third electrical compensation path
221: fourth electrical compensation path
240: second node
151: delay element
202: third input
115: first reproduction filter
113: first adaptive filter
123: replica of the first adaptive filter
125: second reproduction filter
120: first tap
315: third reproduction filter
313: second adaptive filter
323: replica of the second adaptive filter
325: fourth reproduction filter
220: second tap
131: first adaptation circuit
231: second adaptation circuit
204: error signal
208: third output
215: fifth reproduction filter
217: sixth reproduction filter.

Figure 11A:
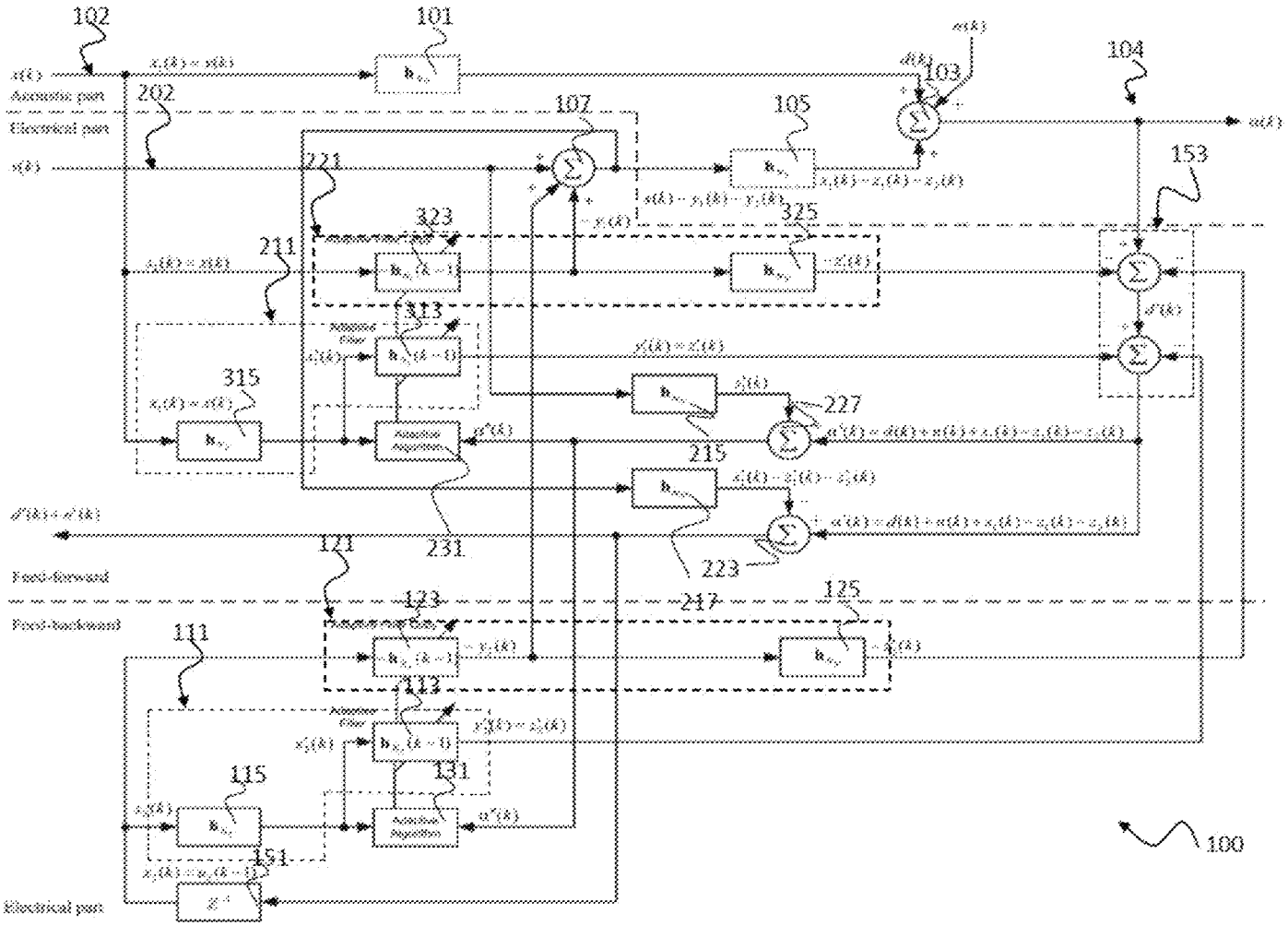
FIG. 11A shows a block diagram illustrating the Modified Hybrid ANC system with far-end signal compensation 100 according to an implementation form.
Figure 11B:
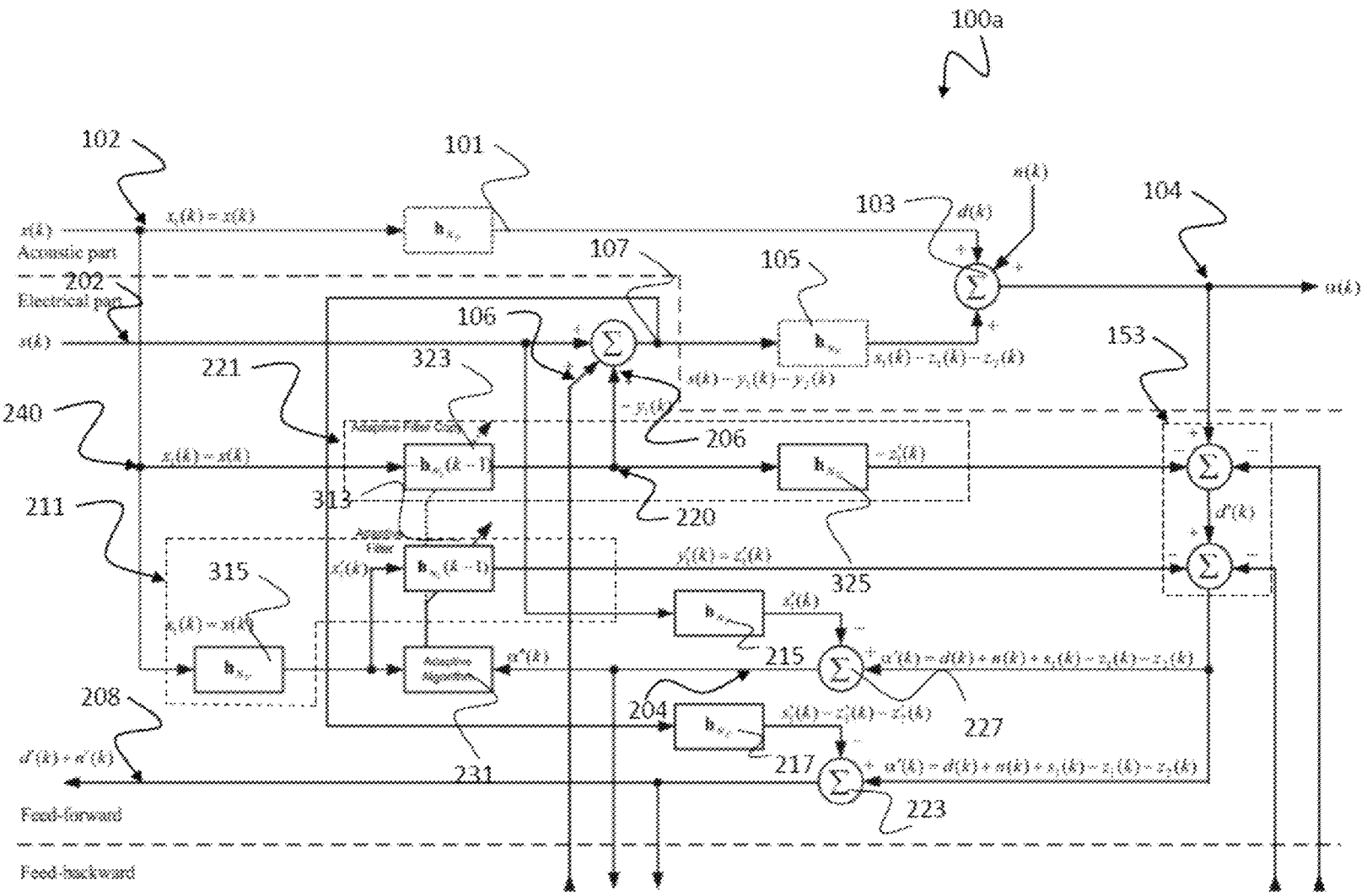
FIG. 11B shows a block diagram illustrating the upper part 100*a* (acoustic part and Feed-Forward electrical part) of the Modified Hybrid ANC system with far-end signal compensation 100 depicted in FIG. 11A.
Figure 11C:
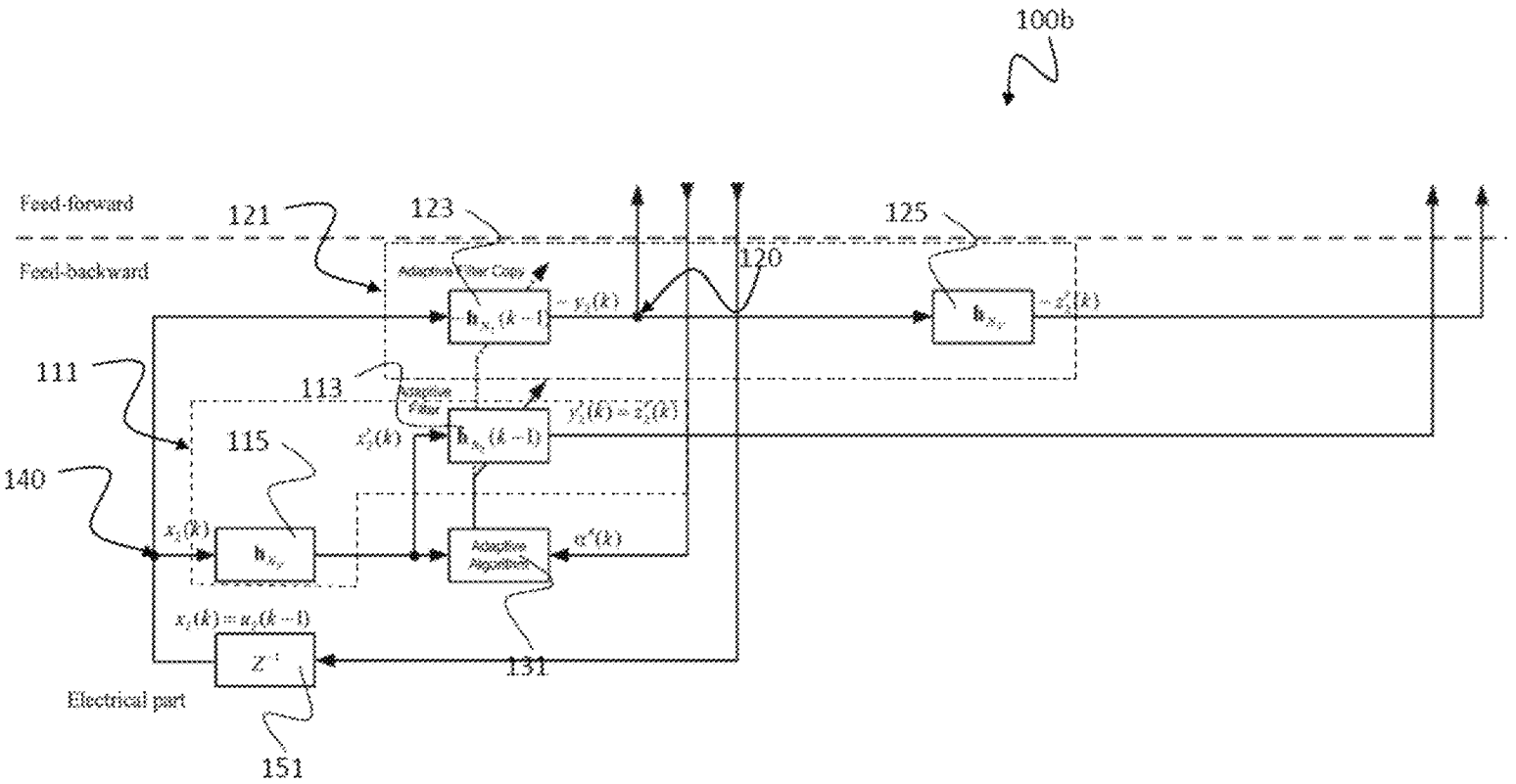
FIG. 11C shows a block diagram illustrating the lower part 100*b* (Feed-Backward electrical part) of the Modified Hybrid ANC system with far-end signal compensation 100 depicted in FIG. 11A.

FIG. 11A shows a block diagram illustrating the Modified Hybrid ANC system with far-end signal compensation 100 according to an implementation form. The upper part 100*a* (acoustic part and Feed-Forward electrical part) of the Modified Hybrid ANC system with far-end signal compensation 100 is illustrated in an enlarged view in FIG. 11B. The lower part 100*b* (Feed-Backward electrical part) of the Modified Hybrid ANC system with far-end signal compensation 100 is illustrated in an enlarged view in FIG. 11C.

The active noise cancellation device 100 may be used for cancelling a primary acoustic path 101 between a noise source 102 and a microphone 103 by an overlying secondary acoustic path 105 between a canceling loudspeaker 107 and the microphone 103. The device 100 includes: a first input 104 for receiving a microphone signal α(k) from the microphone 103; a first output 106 for providing a first noise canceling signal $-y_2(k)$ to the canceling loudspeaker 107; a first electrical compensation path 111; and a second electrical compensation path 121. The first electrical compensation path 111 and the second electrical compensation path 121 are coupled in parallel between a first node 140 and the first input 104 to provide the first noise canceling signal $-y_2(k)$. The first node 140 provides a prediction of the noise source 102.

The first electrical compensation path 111 and the second electrical compensation path 121 are coupled by a third subtraction unit 153 to the first input 104. The active noise cancellation device 100 further includes: a second output 206 for providing a second noise canceling signal $-y_1(k)$ to the canceling loudspeaker 107; a third electrical compensation path 211; and a fourth electrical compensation path 221. The third electrical compensation path 211 and the fourth electrical compensation path 221 are coupled in parallel between a second node 240 and the first input 104. The second node 240 provides a feed-forward prediction of the noise source 102 and the first node 140 provides a feed-backward prediction of the noise source 102.

The third electrical compensation path 211 and the fourth electrical compensation path 221 are coupled by the third subtraction unit 153 to the first input 104. The active noise cancellation device 100 includes a delay element 151 coupled between the first input 104 and the first node 140 for providing the feed-backward prediction of the noise source 102.

The active noise cancellation device 100 further includes a third input 202 for receiving a far-end speaker signal s(k). The third input 202 is coupled together with the first output 106 and the second output 206 to the canceling loudspeaker 107. The active noise cancellation device 100 further includes a fifth reproduction filter 215 coupled between the third input 202 and an error input of the first adaptation circuit 131. The fifth reproduction filter 215 reproduces an electrical estimate $h_{Ns'}$ of the secondary acoustic path 105. The device 100 includes a sixth reproduction filter 217 coupled between the canceling loudspeaker 107 and the first input 104. The sixth reproduction filter 217 reproduces an electrical estimate $h_{Ns'}$ of the secondary acoustic path 105. The device 100 includes a second subtraction unit 227 configured to subtract an output of the fifth reproduction filter 215 from an output of the third subtraction unit 153 to provide an error signal 204 to the first adaptation circuit 131 and the second adaptation circuit 231. The device 100 includes a first subtraction unit 223 configured to subtract an output of the sixth reproduction filter 217 from an output of the third subtraction unit 153 to provide a second compensation signal to the delay element 151 and to provide the second compensation signal as far-end speech with noise d'(k)+n'(k) at a third output 208.

The first electrical compensation path 111 includes a first reproduction filter 115 cascaded with a first adaptive filter 113. The first reproduction filter 115 reproduces an electrical estimate $h_{Ns'}$ of the secondary acoustic path 105. The second electrical compensation path 121 includes a replica 123 of the first adaptive filter 113 which replica 123 is cascaded with a second reproduction filter 125 reproducing the electrical estimate $h_{Ns'}$ of the secondary acoustic path 105. A first tap 120 between the replica 123 of the first adaptive filter 113 and the second reproduction filter 125 is coupled to the first output 106.

The third electrical compensation path 211 includes a third reproduction filter 315 cascaded with a second adaptive filter 313, the third reproduction filter 315 reproducing an electrical estimate $h_{Ns'}$ of the secondary acoustic path 105. The fourth electrical compensation path 221 includes a replica 323 of the second adaptive filter 313 cascaded with a fourth reproduction filter 325 reproducing the electrical estimate $h_{Ns'}$ of the secondary acoustic path 105. A second tap 220 between the replica 323 of the second adaptive filter 313 and the fourth reproduction filter 325 is coupled to the second output 206.

The active noise cancellation device 100 includes a first adaptation circuit 131 configured to adjust filter weights of the first adaptive filter 113; and a second adaptation circuit 231 configured to adjust filter weights of the second adaptive filter 313.

The Modified Hybrid ANC system with far-end signal compensation 100, see FIG. 11 (*a,b,c*), is similar to the Hybrid ANC system architecture 70, see FIG. 7, which simultaneously uses two technologies, as presented in FIGS. 9 and 10, in each FF and FB parts of the ANC system. This allows to use in the architecture, see FIG. 11 (*a,b,c*), the gradient search based Adaptive Algorithm with maximal step-size $\mu_{max}$, as defined in equation (22), or the efficient RLS Adaptive Algorithm in the both cases: when there is no sound s(k) (far-end speech or music, coming from sound-reproducing systems or networks), eliminated by a loudspeaker, that also produces anti-noise. The solution accelerates the adaptation of the Modified Hybrid ANC system 100, see FIG. 11 (*a,b,c*), and allows it to operate, when there is the sound s(k).

Here, the far-end signal free error signal α"(k) for modified adaptive filters 113, 313 is determined in three steps as $$\begin{aligned} d_2'(k) &= \alpha(k) - [-z_1'(k) - z_2'(k)] = \\ &= d(k) + n(k) + s_1(k) - z_1(k) - \\ &\quad z_2(k) - [-z_1'(k) - z_2'(k)] = \\ &= d(k) + n(k) + s_1(k) - z_1(k) - z_2(k) + z_1'(k) + z_2'(k) \end{aligned} \tag{36}$$

$$\begin{aligned} \alpha'(k) &= d'(k) - y_1'(k) - y_2'(k) = \\ &= d(k) + n(k) + s_1(k) - z_1(k) - z_2(k) + \\ &\quad z_1'(k) + z_2'(k) - z_1'(k) - z_2'(k) = \\ &= d(k) + n(k) + s_1(k) - z_1(k) - z_2(k) = \alpha(k) \end{aligned} \tag{37}$$

$$\begin{aligned} \alpha''(k) &= \alpha'(k) - s_2'(k) \\ &= d(k) + n(k) + s_1(k) - z_1(k) - z_2(k) - s_1'(k) \approx \\ &\approx d(k) + n(k) - z_1(k) - z_2(k). \end{aligned} \tag{38}$$

The input signal for the FB branch of adaptive filter is estimated as $$\begin{aligned} u_2(k) &= \alpha'(k) - [s_1'(k) - z_1'(k) - z_2'(k)] = \\ &= d(k) + n(k) + s_1(k) - z_1(k) - z_2(k) - \\ &\quad s_1'(k) + z_1'(k) + z_2'(k) \approx \\ &\approx d(k) + n(k). \end{aligned} \tag{39}$$

The signal in equation (39) is also used for noise activity detection.

Figure 12:
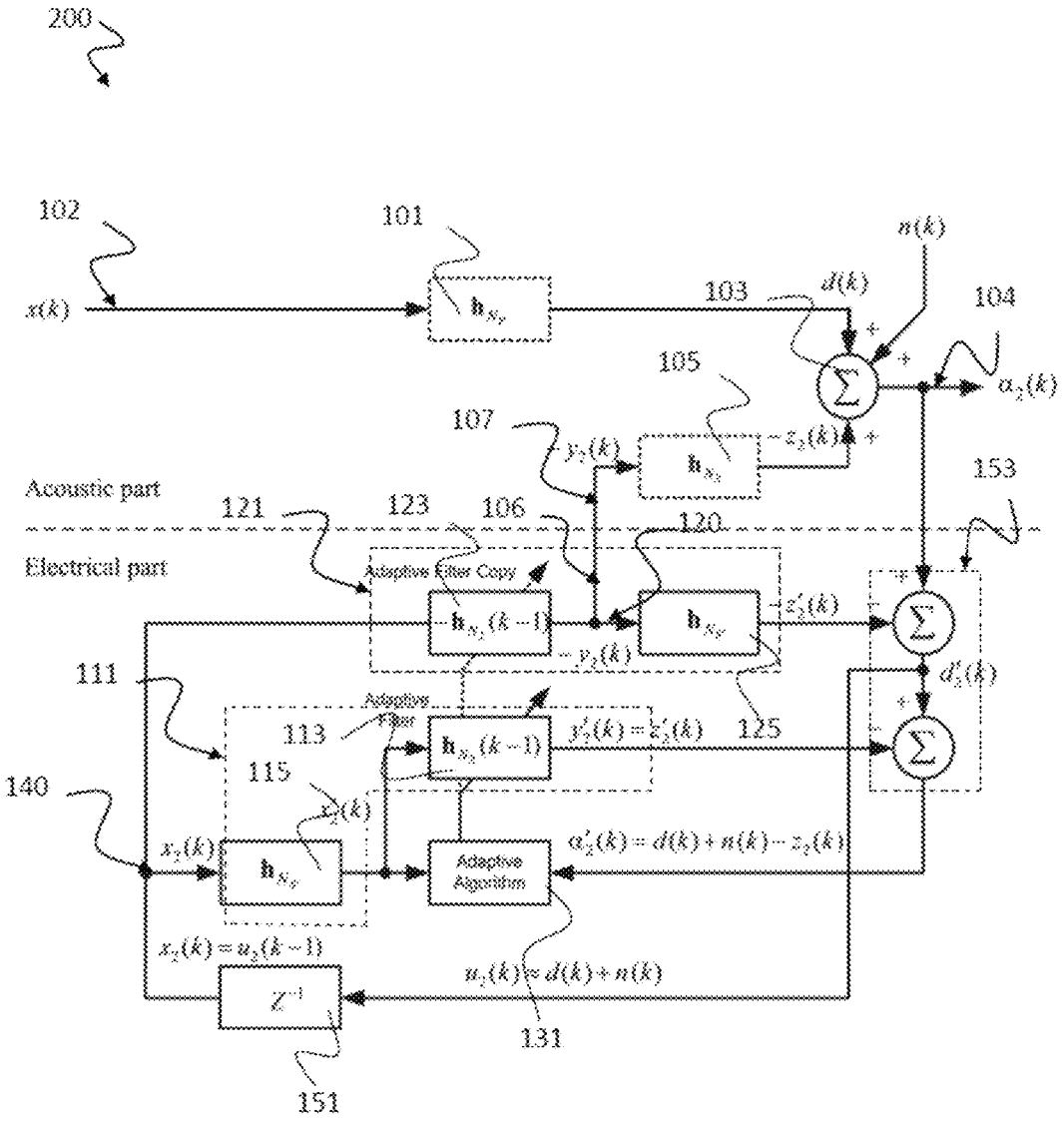
FIG. 12 shows a block diagram illustrating the Modified FB ANC system 200 according to an implementation form.

FIG. 12 shows a block diagram illustrating the Modified FB ANC system 200 according to an implementation form.

The active noise cancellation device 200 may be used for cancelling a primary acoustic path 101 between a noise source 102 and a microphone 103 by an overlying secondary acoustic path 105 between a canceling loudspeaker 107 and the microphone 103. The device 200 includes: a first input 104 for receiving a microphone signal α(k) from the microphone 103; a first output 106 for providing a first noise canceling signal $-y_2(k)$ to the canceling loudspeaker 107; a first electrical compensation path 111; and a second electrical compensation path 121. The first electrical compensation path 111 and the second electrical compensation path 121 are coupled in parallel between a first node 140 and the first input 104 to provide the first noise canceling signal $-y_2(k)$. The first node 140 provides a prediction of the noise source 102.

The first electrical compensation path 111 and the second electrical compensation path 121 are coupled by a third subtraction unit 153 to the first input 104. The active noise cancellation device 200 includes a delay element 151 coupled between the first input 104 and the first node 140 for providing the feed-backward prediction of the noise source 102.

The first electrical compensation path 111 includes a first reproduction filter 115 cascaded with a first adaptive filter 113, the first reproduction filter 115 reproducing an electrical estimate $h_{Ns'}$ of the secondary acoustic path 105. The second electrical compensation path 121 includes a replica 123 of the first adaptive filter 113 which replica 123 is cascaded with a second reproduction filter 125 reproducing the electrical estimate $h_{Ns'}$ of the secondary acoustic path 105. A first tap 120 between the replica 123 of the first adaptive filter 113 and the second reproduction filter 125 is coupled to the first output 106.

The Modified FB ANC system 200, see FIG. 12, is a particular case of the General ANC system 100, see FIG. 11 (*a,b,c*). It does not contain FF part and the circuit for the sound s(k) compensation, but contains modification, similar to that, presented in FIG. 9. The ANC system 200 can be used in cases, when there is no sound s(k) (so, there is no need for the sound compensation), but it is required to use gradient search based Adaptive Algorithms with maximal step-size $\mu_{max}$, e.g. as defined in equation (22), or to use the efficient RLS Adaptive Algorithms for better performance (faster convergence comparing with that in the FB ANC system, see FIG. 6). The solution accelerates the adaptation of the Modified FB ANC system, see FIG. 12.

In the Modified FB ANC system 200, see FIG. 12, the desired signal of Adaptive Filter 113 is $$\begin{aligned} d_2'(k) &= \alpha_2(k) - [-z_2'(k)] \\ &= d(k) + n(k) - z_2(k) - [-z_2'(k)] = \\ &= d(k) + n(k) - z_2(k) + z_2'(k) \\ &\approx d(k) + n(k) \\ &= u_2(k), \end{aligned} \tag{40}$$

i.e. is the same as $u_2(k)$, used for the generation of predicted signal $x_2(k)$ of noise source, see FIG. 6 and equation (14). So, there is no need to duplicate a circuit, producing signal $u_2(k)=d_2'(k)$.

Other distinguishing features of the Modified FB ANC system, see FIG. 12, from FB ANC system, see FIG. 6, are the following ones. Filtering part 113 of Adaptive Filter is substituted by Adaptive Filter Copy 123 and Adaptive Algorithm 131 is substituted by the circuit, marked by 313, 231, 113, 131 in FIG. 11 (*a,b,c*), i.e. the same as in the Modified FF ANC system, see FIG. 9.

Figure 13A:
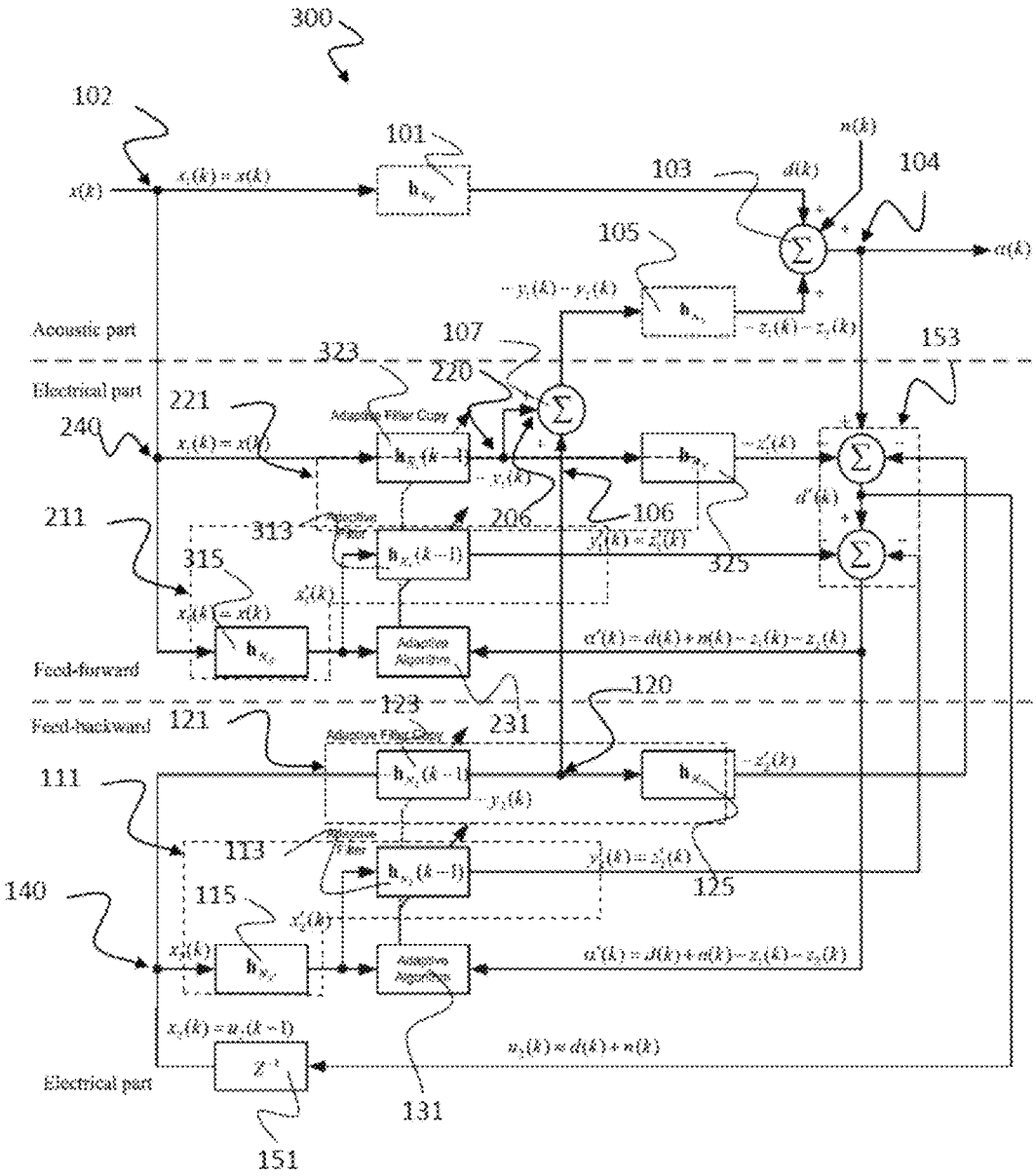
FIG. 13A shows a block diagram illustrating the Modified Hybrid ANC system 300 according to an implementation form.
Figure 13B:
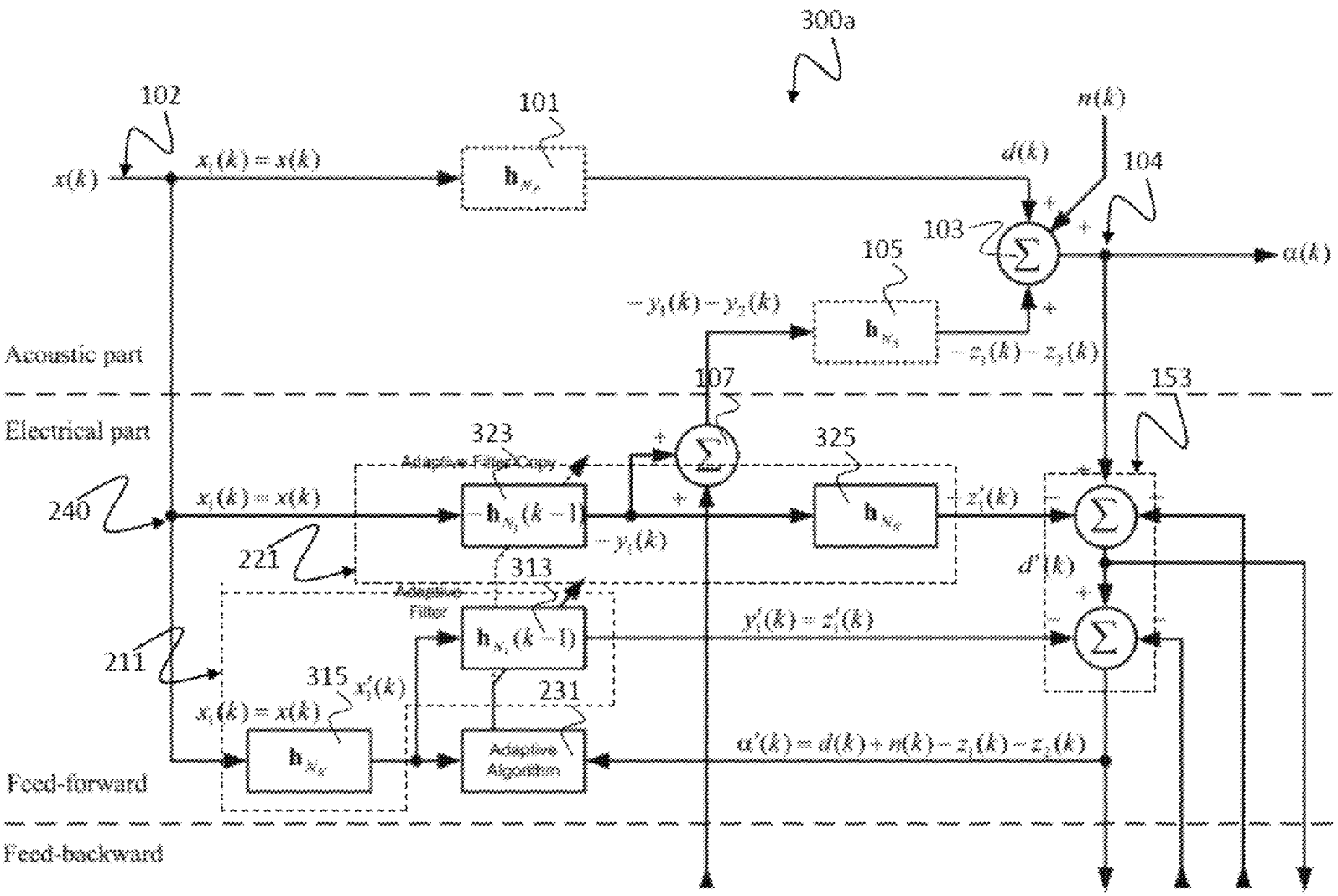
FIG. 13B shows a block diagram illustrating the upper part 300*a* (acoustic part and Feed-Forward electrical part) of the Modified Hybrid ANC system 300 depicted in FIG. 13A.
Figure 13C:
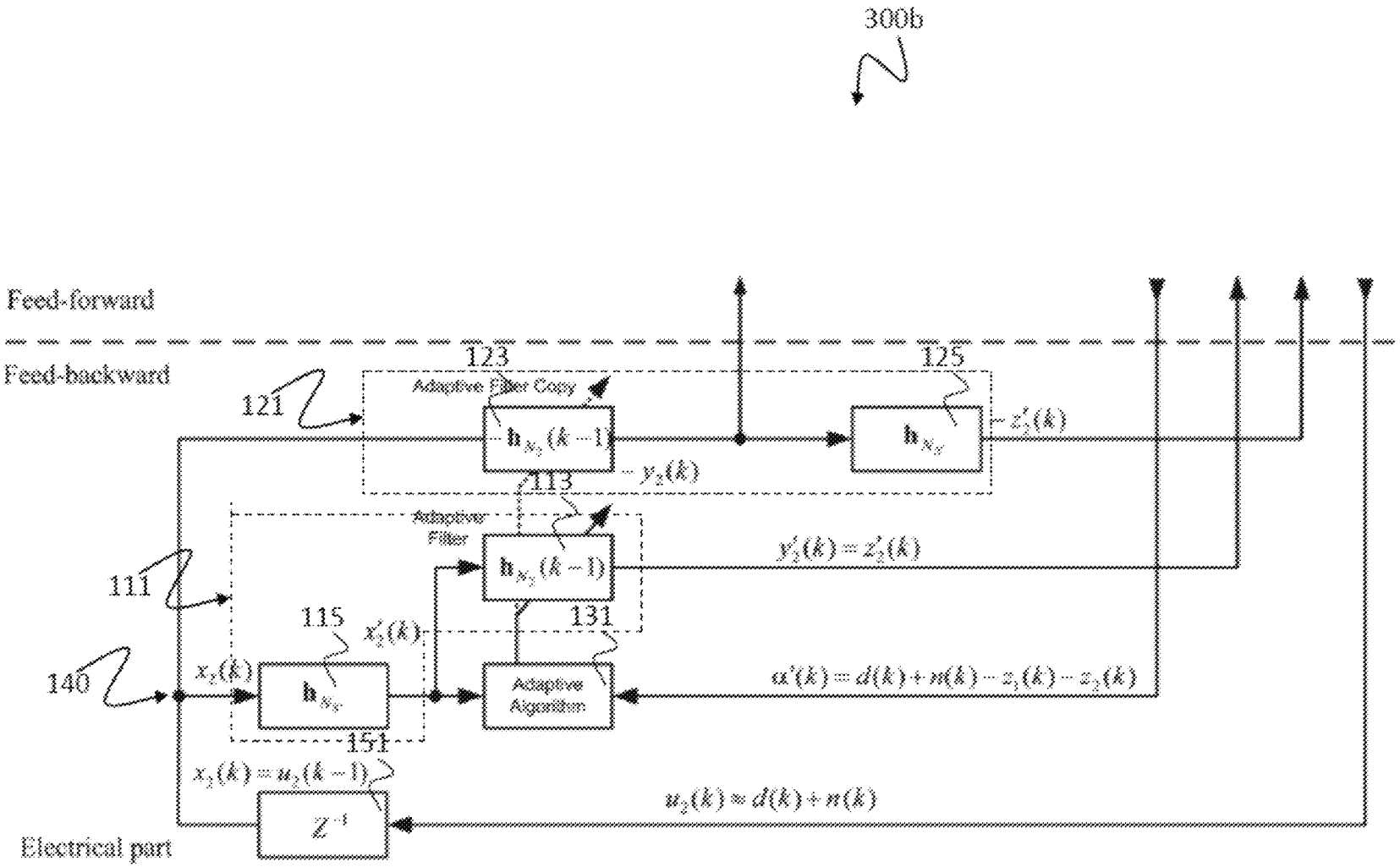
FIG. 13C shows a block diagram illustrating the lower part 300*b* (Feed-Backward electrical part) of the Modified Hybrid ANC system 300 depicted in FIG. 13A.

FIG. 13A shows a block diagram illustrating the Modified Hybrid ANC system 300 according to an implementation form. The upper part 300*a* (acoustic part and Feed-Forward electrical part) of the Modified Hybrid ANC system 300 is illustrated in an enlarged view in FIG. 13B. The lower part 300*b* (Feed-Backward electrical part) of the Modified Hybrid ANC system 300 is illustrated in an enlarged view in FIG. 13C.

The active noise cancellation device 300 may be used for cancelling a primary acoustic path 101 between a noise source 102 and a microphone 103 by an overlying secondary acoustic path 105 between a canceling loudspeaker 107 and the microphone 103. The device 300 includes: a first input 104 for receiving a microphone signal α(k) from the microphone 103; a first output 106 for providing a first noise canceling signal $-y_2(k)$ to the canceling loudspeaker 107; a first electrical compensation path 111; and a second electrical compensation path 121. The first electrical compensation path 111 and the second electrical compensation path 121 are coupled in parallel between a first node 140 and the first input 104 to provide the first noise canceling signal $-y_2(k)$. The first node 140 provides a prediction of the noise source 102.

The first electrical compensation path 111 and the second electrical compensation path 121 are coupled by a third subtraction unit 153 to the first input 104. The active noise cancellation device 300 further includes: a second output 206 for providing a second noise canceling signal $-y_1(k)$ to the canceling loudspeaker 107; a third electrical compensation path 211; and a fourth electrical compensation path 221. The third electrical compensation path 211 and the fourth electrical compensation path 221 are coupled in parallel between a second node 240 and the first input 104. The second node 240 provides a feed-forward prediction of the noise source 102 and the first node 140 provides a feed-backward prediction of the noise source 102.

The third electrical compensation path 211 and the fourth electrical compensation path 221 are coupled by the third subtraction unit 153 to the first input 104. The active noise cancellation device 300 includes a delay element 151 coupled between the first input 104 and the first node 140 for providing the feed-backward prediction of the noise source 102.

The first electrical compensation path 111 includes a first reproduction filter 115 cascaded with a first adaptive filter 113, the first reproduction filter 115 reproducing an electrical estimate $h_{Ns'}$ of the secondary acoustic path 105. The second electrical compensation path 121 includes a replica 123 of the first adaptive filter 113 cascaded with a second reproduction filter 125 reproducing the electrical estimate $h_{Ns'}$ of the secondary acoustic path 105.

A first tap 120 between the replica 123 of the first adaptive filter 113 and the second reproduction filter 125 is coupled to the first output 106. The third electrical compensation path 211 includes a third reproduction filter 315 cascaded with a second adaptive filter 313, the third reproduction filter 315 reproducing an electrical estimate $h_{Ns'}$ of the secondary acoustic path 105. The fourth electrical compensation path 221 includes a replica 323 of the second adaptive filter 313 cascaded with a fourth reproduction filter 325 reproducing the electrical estimate $h_{Ns'}$ of the secondary acoustic path 105.

A second tap 220 between the replica 323 of the second adaptive filter 313 and the fourth reproduction filter 325 is coupled to the second output 206. The active noise cancellation device 300 includes: a first adaptation circuit 131 configured to adjust filter weights of the first adaptive filter 113; and a second adaptation circuit 231 configured to adjust filter weights of the second adaptive filter 313.

The Modified Hybrid ANC system 300, see FIG. 13, is a particular case of the General ANC system 100, see FIG. 11 (*a,b,c*). It does not contain the circuit for the sound s(k) compensation, but contains the modification, similar to that, presented in FIG. 9, in both FF and FB parts. The ANC system can be used in cases, when there is no sound s(k) (so, there is no need for the sound compensation), but it is required to use gradient search based Adaptive Algorithms with maximal step-size $\mu_{max}$, defined as in equation (22), or the efficient RLS Adaptive Algorithms for better performance (faster convergence compared with that in the Hybrid ANC system 70, see FIG. 7). The solution accelerates the adaptation of the Modified Hybrid ANC system 300, see FIG. 13.

The Modified Hybrid ANC system 300, see FIG. 13A, similarly to the Hybrid ANC system 70, see FIG. 7, can be also viewed as the combination of the Modified FF ANC system 90, see FIG. 9, and Modified FB ANC system 200, see FIG. 12.

Here, the cancelled noise signal is determined as $$\alpha(k)=d(k)+n(k)-z_1(k)-z_2(k), \tag{41}$$

The desired signal for the both Adaptive Filters 313, 113 is determined as $$\begin{aligned} d'(k) &= d(k)+n(k)-z_1(k)-z_2(k)-[-z'_1(k)]-[-z'_2(k)] = \\ &= d(k)+n(k)-z_1(k)-z_2(k)+z'_1(k)+z'_2(k). \end{aligned} \tag{42}$$

The error signal for the both Adaptive Algorithms 231, 131 is determined as $$\begin{aligned} \alpha'(k) &= d'(k)-y_1(k)-y_2(k) = \\ &= d(k)+n(k)-z_1(k)-z_2(k)+z'_1(k)+ \\ &\quad z'_2(k)-y'_1(k)-y'_2(k) = \\ &= d(k)+n(k)-z_1(k)-z_2(k)+z'_1(k)+z'_2(k)- \\ &\quad z'_1(k)-z'_2(k) = \\ &= d(k)+n(k)-z_1(k)-z_2(k) \\ &= \alpha(k). \end{aligned} \tag{43}$$

So, the both Adaptive Filters 313, 113, used in used the Modified Hybrid ANC system 300, can be viewed as a 2-channel adaptive filter.

The input signal for the FB branch of the filter is estimated similarly (14) as $$\begin{aligned} u_2(k) &= \alpha(k)-[-z'_1(k)]-[-z'_2(k)] = \\ &= d'(k) \\ &= d(k)+n(k)-z_1(k)-z_2(k)-[-z'_1(k)]-[-z'_2(k)] = \\ &= d(k)+n(k)-z_1(k)-z_2(k)+z'_1(k)+z'_2(k) \\ &\approx d(k)+n(k). \end{aligned} \tag{44}$$

Figure 14:
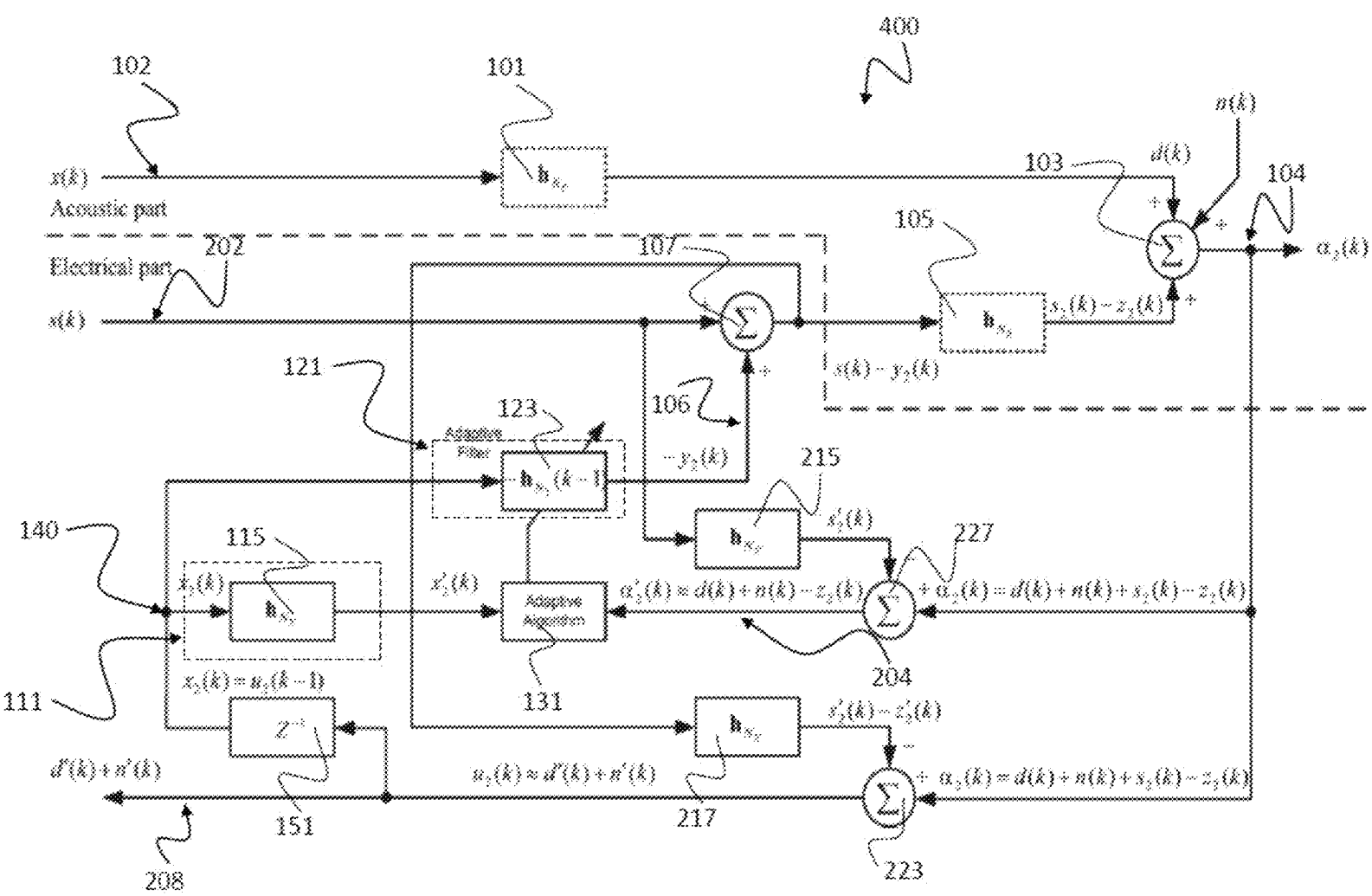
FIG. 14 shows a block diagram illustrating the FB ANC system with far-end signal compensation 400 according to an implementation form.

FIG. 14 shows a block diagram illustrating the FB ANC system with far-end signal compensation 400 according to an implementation form.

The active noise cancellation device 400 may be used for cancelling a primary acoustic path 101 between a noise source 102 and a microphone 103 by an overlying secondary acoustic path 105 between a canceling loudspeaker 107 and the microphone 103. The device 400 includes: a first input 104 for receiving a microphone signal α(k) from the microphone 103; a first output 106 for providing a first noise canceling signal $-y_2(k)$ to the canceling loudspeaker 107; a first electrical compensation path 111; and a second electrical compensation path 121. The first electrical compensation path 111 and the second electrical compensation path 121 are coupled in parallel between a first node 140 and the first input 104. The first node 140 provides a prediction of the noise source 102.

The active noise cancellation device 400 further includes a third input 202 for receiving a far-end speaker signal s(k). The third input 202 is coupled together with the first output 106 and to the canceling loudspeaker 107. The active noise cancellation device 400 further includes a fifth reproduction filter 215 coupled between the third input 202 and an error signal 204 of the first adaptation circuit 131, the fifth reproduction filter 215 reproducing an electrical estimate $h_{Ns'}$ of the secondary acoustic path 105. The device includes a sixth reproduction filter 217 coupled between the first output 106 and the first input 104. The sixth reproduction filter 217 reproduces an electrical estimate $h_{Ns'}$ of the secondary acoustic path 105. The device 400 includes a second subtraction unit 227 configured to subtract an output of the fifth reproduction filter 215 from the microphone signal (α(k)) to provide an error signal 204 to the first adaptation circuit 131. The device 400 includes a first subtraction unit 223 configured to subtract an output of the sixth reproduction filter 217 from the microphone signal (α(k)) to provide a compensation signal to the delay element 151 which compensation signal is provided as far-end speech with noise d'(k)+n'(k) at a third output 208.

The second electrical compensation path 121 includes a replica of the first adaptive filter 123. The first electrical compensation path 111 includes a first reproduction filter 115 cascaded with a first adaptation circuit 131 which is configured to adjust filter weights of the replica of the first adaptive filter 123.

The FB ANC system 400, see FIG. 14, is a particular case of the General ANC system 100, see FIG. 11 (*a,b,c*). It does not contain FF part, does not contain the modification, similar to that, presented in FIG. 9, but contains the circuit for the sound s(k) compensation. The ANC system 400 can be used in cases, when there is sound s(k) (so, there is need for the sound compensation) and gradient search based Adaptive Algorithms can be used with maximal step-size $\mu_{max}$, as defined in equation (13) or the efficient RLS Adaptive Algorithms are not required, or cannot be used due to limited computation resources. I.e. slow adaptation is allowed. The solution allows the FB ANC system 400, see FIG. 14, to operate, when there is the sound s(k).

The FB ANC system 400 with far-end signal compensation, see FIG. 14, is distinguished from FB ANC system 60, see FIG. 6, in the following way. Similarly to the FF ANC system with far-end signal compensation 95, see FIG. 10, the error signal for Adaptive Algorithm 131 is produced as $$\alpha'_2(k)=\alpha_2(k)-s'_2(k)=d(k)+n(k)+s_2(k)-z_2(k)-s'_2(k)\approx d(k)+n(k)-z_2(k). \tag{45}$$

The input signal for the filter 113 is estimated similarly (14) as $$u_2(k)=\alpha_2(k)-[s'_2(k)-z'_2(k)]=d(k)+n(k)+s_2(k)-z_2(k)-s'_2(k)+z'_2(k)\approx d(k)+n(k). \tag{46}$$

For that, it is possible to use the same circuit as in FIG. 10 for the FF ANC system with far-end signal compensation 95.

The signal as defined in equation (46) is also used for noise activity detection.

Figure 15A:
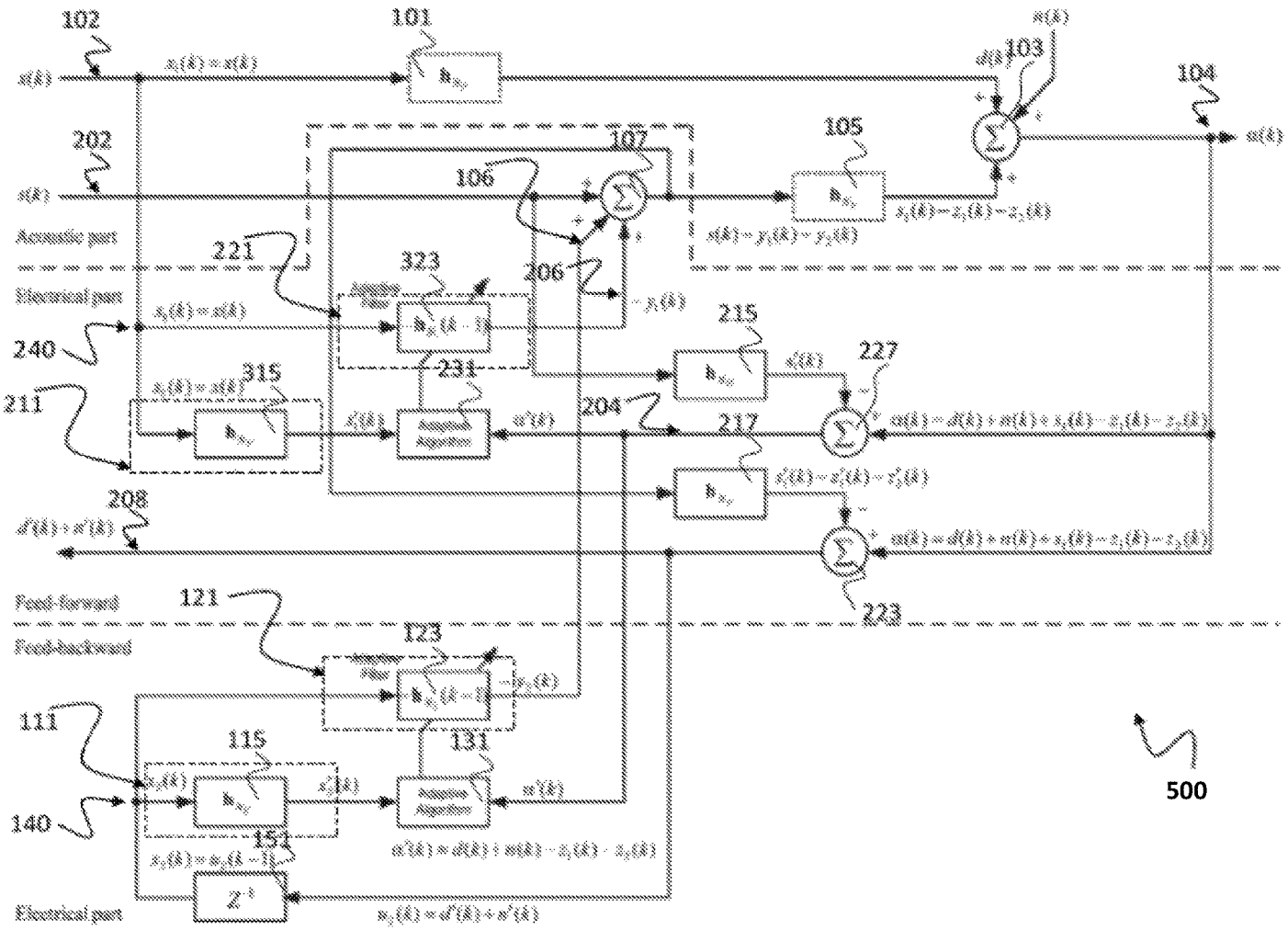
FIG. 15A shows a block diagram illustrating the Hybrid ANC system with far-end signal compensation 500 according to an implementation form.
Figure 15B:
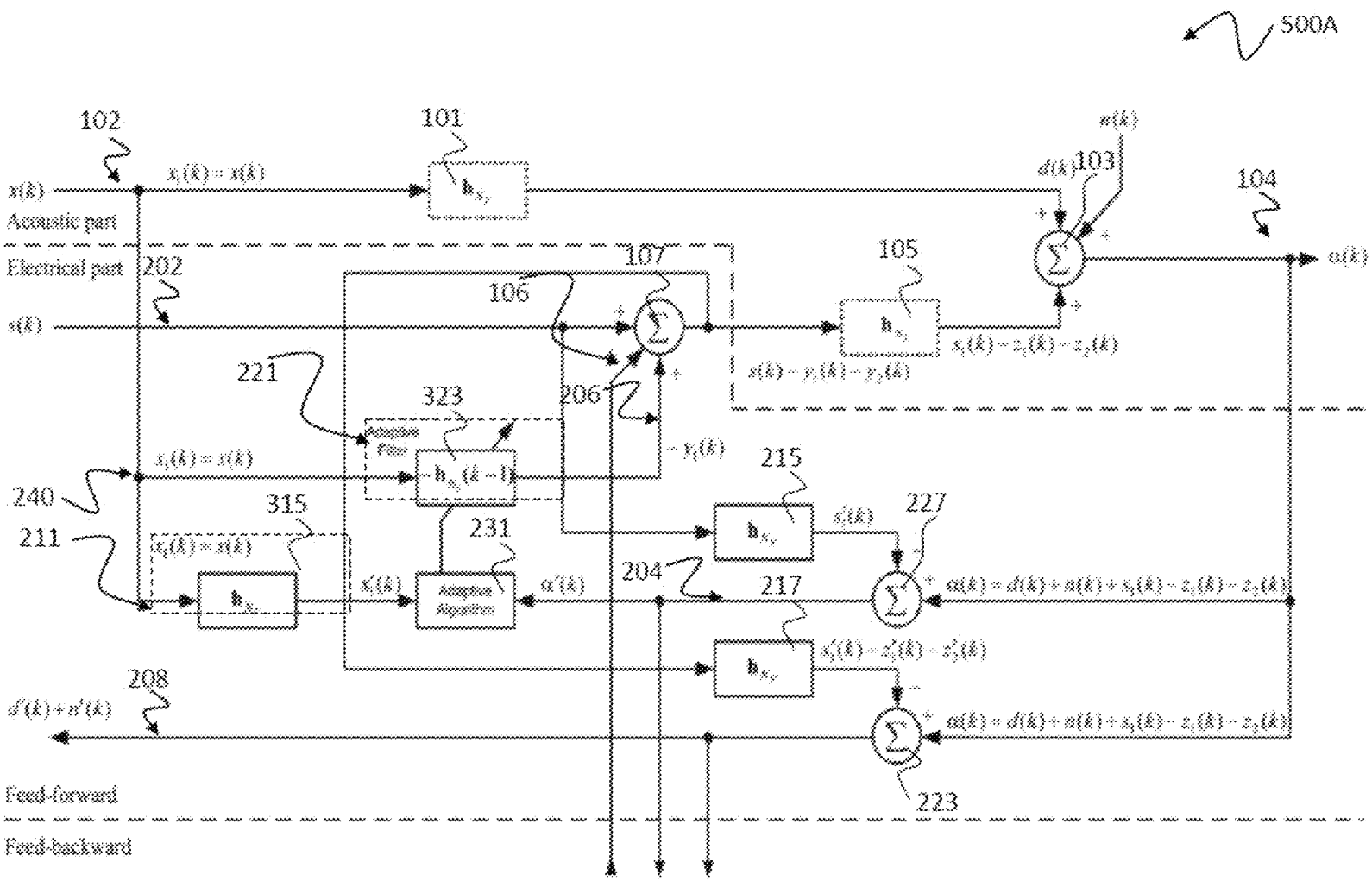
FIG. 15B shows a block diagram illustrating the upper part 500*a* (acoustic part and Feed-Forward electrical part) of the Hybrid ANC system with far-end signal compensation 500 depicted in FIG. 15A.
Figure 15C:
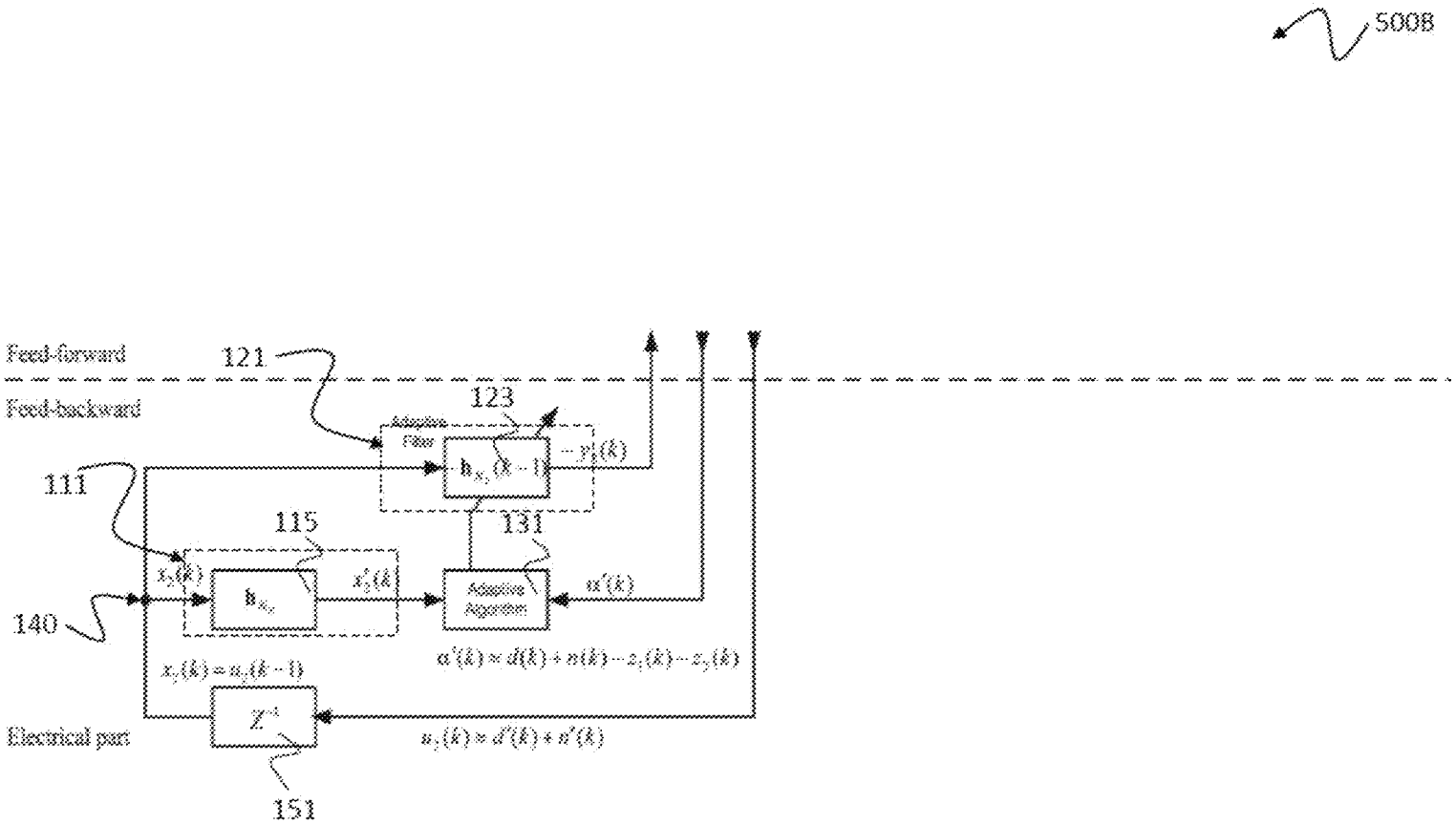
FIG. 15C shows a block diagram illustrating the lower part 500*b* (Feed-Backward electrical part) of the Hybrid ANC system with far-end signal compensation 500 depicted in FIG. 15A.

FIG. 15A shows a block diagram illustrating the Hybrid ANC system with far-end signal compensation 500 according to an implementation form. The upper part 500*a* (acoustic part and Feed-Forward electrical part) of the Hybrid ANC system with far-end signal compensation 500 is illustrated in an enlarged view in FIG. 15B. The lower part 500*b* (Feed-Backward electrical part) of the Hybrid ANC system with far-end signal compensation 500 is illustrated in an enlarged view in FIG. 15C.

The active noise cancellation device 500 may be used for cancelling a primary acoustic path 101 between a noise source 102 and a microphone 103 by an overlying secondary acoustic path 105 between a canceling loudspeaker 107 and the microphone 103. The device 500 includes: a first input 104 for receiving a microphone signal α(k) from the microphone 103; a first output 106 for providing a first noise canceling signal $-y_2(k)$ to the canceling loudspeaker 107; a first electrical compensation path 111; and a second electrical compensation path 121. The first electrical compensation path 111 and the second electrical compensation path 121 are coupled in parallel between a first node 140 and the first input 104 to provide the first noise canceling signal $-y_2(k)$. The first node 140 provides a prediction of the noise source 102.

The active noise cancellation device 500 further includes a third input 202 for receiving a far-end speaker signal s(k). The third input 202 is coupled together with the first output 106 and the second output 206 to the canceling loudspeaker 107. The active noise cancellation device 500 further includes a fifth reproduction filter 215 coupled between the third input 202 and an error input of the first adaptation circuit 131, the fifth reproduction filter 215 reproducing an electrical estimate $h_{Ns'}$ of the secondary acoustic path 105. The device 500 includes a sixth reproduction filter 217 coupled between the canceling loudspeaker 107 and the first input 104, the sixth reproduction filter 217 reproducing an electrical estimate $h_{Ns'}$ of the secondary acoustic path 105. The device 500 includes a second subtraction unit 227 configured to subtract an output of the fifth reproduction filter 215 from the microphone signal (α(k)) to provide an error signal 204 to the first adaptation circuit 131 and to the second adaptation circuit 231. The device 500 includes a first subtraction unit 223 configured to subtract an output of the sixth reproduction filter 217 from the microphone signal (α(k)) to provide a compensation signal to the delay element 151 which compensation signal is provided as far-end speech with noise d'(k)+n'(k) to a third output 208.

The second electrical compensation path 121 includes a replica of the first adaptive filter 123. The first electrical compensation path 111 includes a first reproduction filter 115 cascaded with a first adaptation circuit 131 which is configured to adjust filter weights of the replica of the first adaptive filter 123.

The fourth electrical compensation path 221 includes a replica of the second adaptive filter 323. The third electrical compensation path 211 includes a third reproduction filter 315 cascaded with a second adaptation circuit 231 which is configured to adjust filter weights of the second adaptive filter 313.

The Hybrid ANC system 500, see FIG. 15A, is a particular case of the General ANC system 100, see FIG. 11 (*a,b,c*). It contains the circuit for the sound s(k) compensation, but does not contain the modification, similar to that, presented in FIG. 9. The ANC system 500 can be used in the cases, when there is sound s(k) (so, there is need for the sound compensation) and gradient search based Adaptive Algorithms can be used with maximal step-size $\mu_{max}$, as defined in equation (13) or the efficient RLS Adaptive Algorithms are not required, or cannot be used due to limited computation resources. I.e. slow adaptation is allowed. The solution allows the Hybrid ANC system, see FIG. 15, to operate, when there is the sound s(k).

The Hybrid ANC system with far-end signal compensation 500, see FIG. 15A, can be also viewed as the combination of the FF ANC system with far-end signal compensation 95, see FIG. 10, and the FB ANC system with far-end signal compensation 400, see FIG. 14.

Here $$\alpha(k)=d(k)+n(k)+s_1(k)-z_1(k)-z_2(k) \tag{47}$$

and the error signal for the both Adaptive Algorithms 231, 131 is produced as $$\alpha'(k)=\alpha(k)-s'_1(k)=d(k)+n(k)-z_1(k)-z_2(k) \tag{48}$$

The input signal for the filter 113 is estimated similarly (14) as $$\begin{aligned} u_2(k) &= \alpha(k) - [s'_1(k) - z'_1(k) - z'_2(k)] = \\ &= d(k) + n(k) + s_1(k) - z_1(k) - z_2(k) - \\ &\quad s'_1(k) + z'_1(k) + z'_2(k) \\ &\approx d(k) + n(k). \end{aligned} \tag{49}$$

The signal as defined in equation (49) is also used for noise activity detection.

Figure 16:
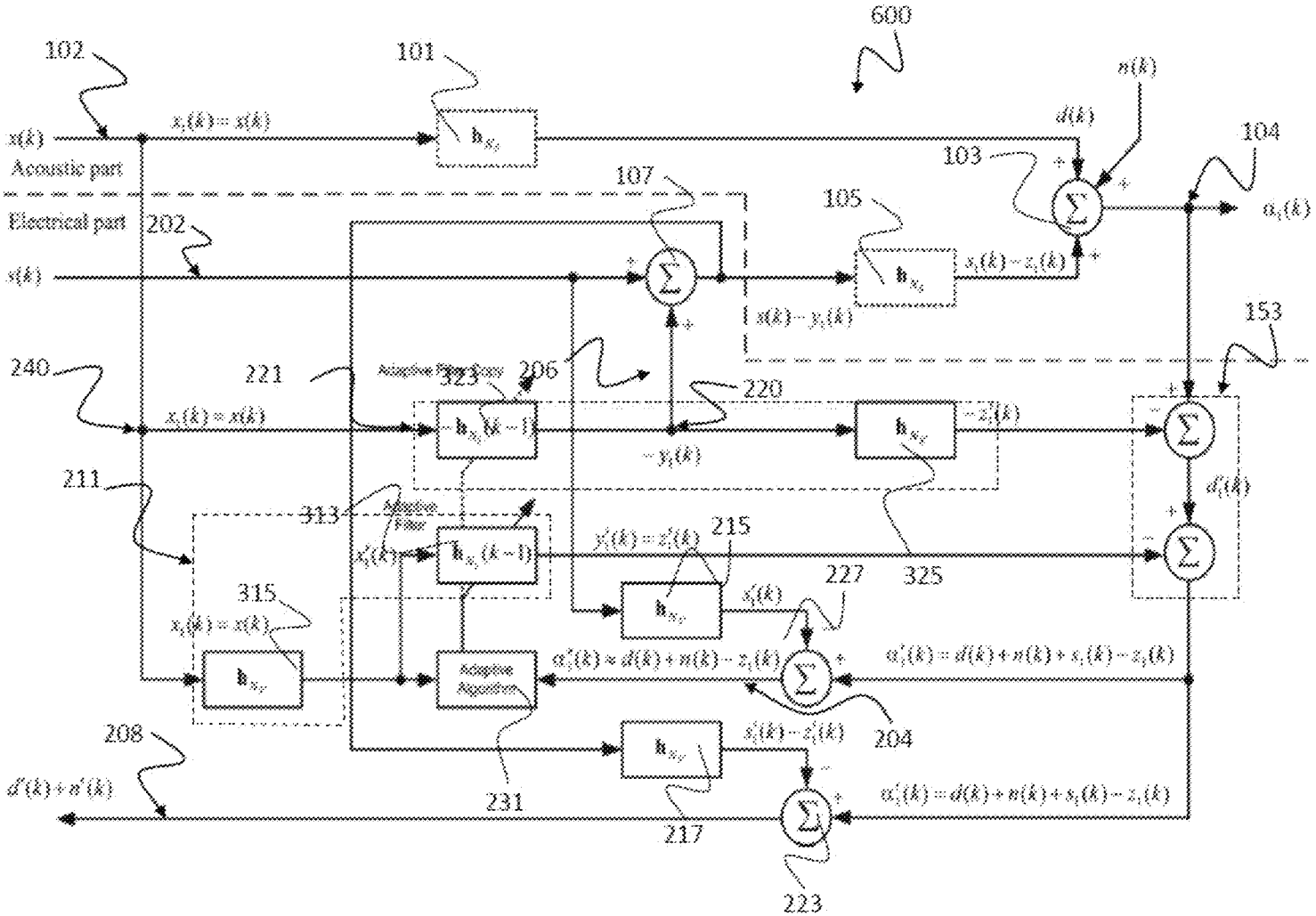
FIG. 16 shows a block diagram illustrating the Modified FF ANC system with far-end signal compensation 600 according to an implementation form.

FIG. 16 shows a block diagram illustrating the Modified FF ANC system with far-end signal compensation 600 according to an implementation form.

The active noise cancellation device 600 may be used for cancelling a primary acoustic path 101 between a noise source 102 and a microphone 103 by an overlying secondary acoustic path 105 between a canceling loudspeaker 107 and the microphone 103. The device 600 includes: a first input 104 for receiving a microphone signal α(k) from the microphone 103; a second output 206 for providing a first noise canceling signal $-y_1(k)$ to the canceling loudspeaker 107; a third electrical compensation path 211; and a fourth electrical compensation path 221. The third electrical compensation path 211 and the fourth electrical compensation path 221 are coupled in parallel between a second node 240 and the first input 104 to provide the second noise canceling signal $-y_1(k)$. The second node 240 provides a prediction of the noise source 102.

The third electrical compensation path 211 and the fourth electrical compensation path 221 are coupled by a third subtraction unit 153 to the first input 104.

The active noise cancellation device 600 further includes a third input 202 for receiving a far-end speaker signal s(k). The third input 202 is coupled together with the first output 106 and the second output 206 to the canceling loudspeaker 107. The active noise cancellation device 600 further includes a fifth reproduction filter 215 coupled between the third input 202 and an error input of the second adaptation circuit 231, the fifth reproduction filter 215 reproducing an electrical estimate $h_{Ns'}$ of the secondary acoustic path 105. The device 600 includes a sixth reproduction filter 217 coupled between the second output 206 and the first input 104, the sixth reproduction filter 217 reproducing an electrical estimate $h_{Ns'}$ of the secondary acoustic path 105. The device 600 includes a second subtraction unit 227 configured to subtract an output of the fifth reproduction filter 215 from the output of the third subtraction unit 153 to provide an error signal 204 to the error input of the second adaptation circuit 231. The device 600 includes a first subtraction unit 223 configured to subtract an output of the sixth reproduction filter 217 from the output of the third subtraction unit 153 to provide a far-end speech with noise signal d'(k)+n'(k) at a third output 208.

The third electrical compensation path 211 includes a third reproduction filter 315 cascaded with a second adaptive filter 313, the third reproduction filter 315 reproducing an electrical estimate $h_{Ns'}$ of the secondary acoustic path 105.

The fourth electrical compensation path 221 includes a replica 323 of the second adaptive filter 313 cascaded with a fourth reproduction filter 325 reproducing the electrical estimate $h_{Ns'}$ of the secondary acoustic path 105.

The Modified FF ANC system with far-end signal compensation 600, see FIG. 16, is a particular case of the General ANC system 100, see FIG. 11 (*a,b,c*). It simultaneously uses two technologies, presented in FIGS. 9 and 10, in FF part of the ANC system. This allows to use in the architecture 600, see FIG. 16, the gradient search based Adaptive Algorithms with maximal step-size $\mu_{max}$, as defined in equation (22), or the efficient RLS Adaptive Algorithms in the both cases: when there is not the sound s(k) (far-end speech or music, coming from sound-reproducing systems or networks), eliminated by a loudspeaker, that also produces anti-noise. The solution accelerates the adaptation of the Modified FF ANC system 600, see FIG. 16, and allows it to operate, when there is the sound s(k).

The Modified FF ANC system with far-end signal compensation 600, see FIG. 16, can be also viewed as the combination of the Modified FF ANC system 90, see FIG. 9, and the FF ANC system with far-end signal compensation 95, see FIG. 10.

Here, the far-end signal free error signal $\alpha_1''(k)$ for the modified adaptive filter 313 is determined in 3 steps as $$\begin{aligned} d_1'(k) &= d(k) + n(k) + s_1(k) - z_1(k) - [-z_1'(k)] \\ &= d(k) + n(k) + s_1(k) - z_1(k) + z_1'(k), \end{aligned} \tag{50}$$

$$\begin{aligned} \alpha_1'(k) &= d_1'(k) - y_1'(k) \\ &= d(k) + n(k) + s_1(k) - z_1(k) + z_1'(k) - z_1'(k) \\ &= \; = d(k) + n(k) + s_1(k) - z_1(k) \\ &= \alpha_1(k) \end{aligned} \tag{51}$$

and $$\begin{aligned} \alpha_1''(k) &= \alpha_1'(k) - s_1'(k) \\ &= d(k) + n(k) + s_1(k) - z_1(k) - s_1'(k) \\ &\approx d(k) + n(k) - z_1(k). \end{aligned} \tag{52}$$

"Noise activity" can be detected, based on the estimation of the signal $$\begin{aligned} \alpha_1'(k) - [s_1'(k) - z_1'(k)] &= d(k) + n(k) + s_1(k) - z_1(k) - \\ &\quad s_1'(k) + z_1'(k) \approx \\ &\approx d(k) + n(k) \\ &= d'(k) + n'(k). \end{aligned} \tag{53}$$

Figure 17:
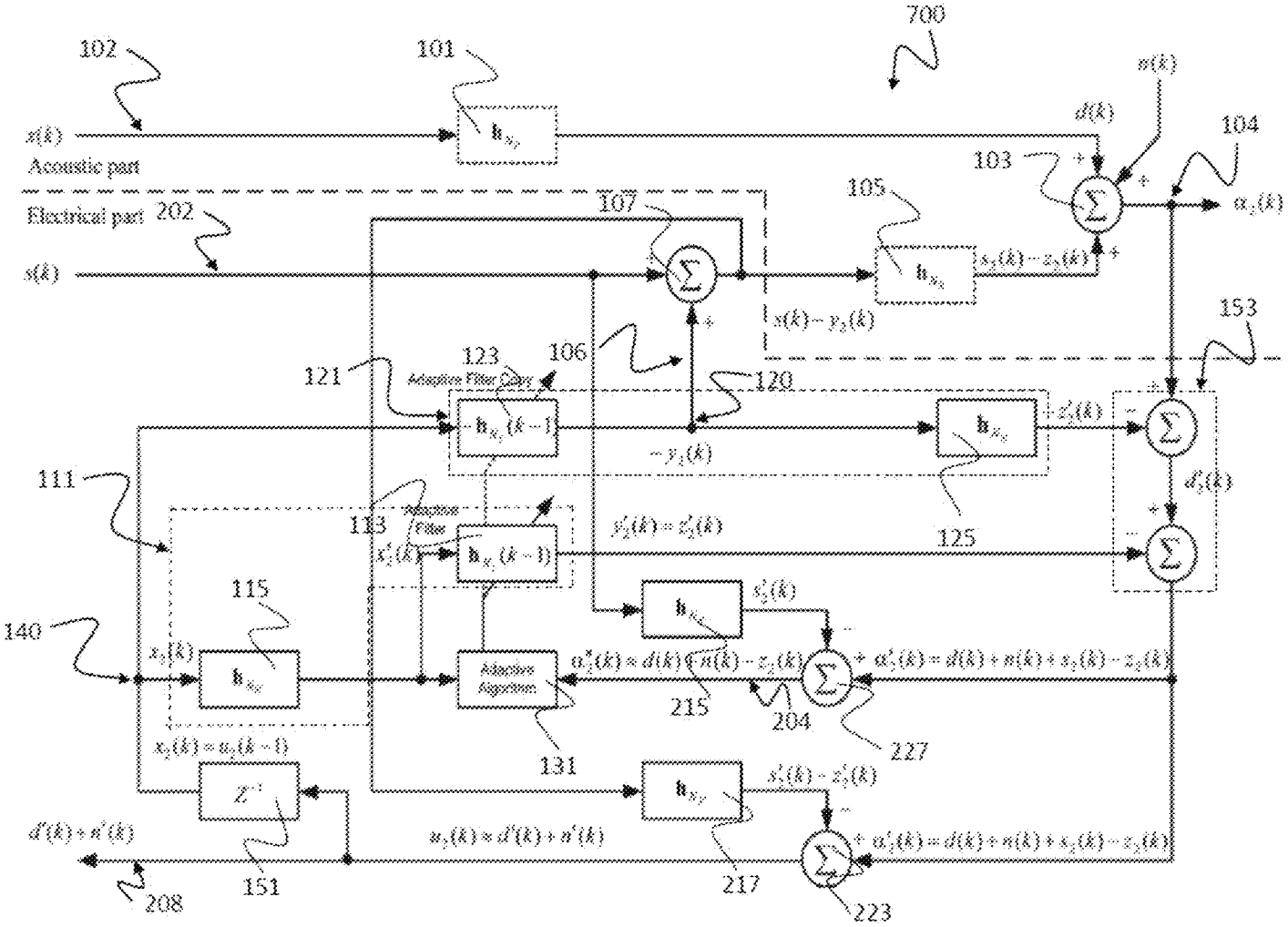
FIG. 17 shows a block diagram illustrating the Modified FB ANC system with far-end signal compensation 700 according to an implementation form.

FIG. 17 shows a block diagram illustrating the Modified FB ANC system with far-end signal compensation 700 according to an implementation form.

The active noise cancellation device 700 may be used for cancelling a primary acoustic path 101 between a noise source 102 and a microphone 103 by an overlying secondary acoustic path 105 between a canceling loudspeaker 107 and the microphone 103. The device 700 includes: a first input 104 for receiving a microphone signal α(k) from the microphone 103; a first output 106 for providing a first noise canceling signal $-y_2(k)$ to the canceling loudspeaker 107; a first electrical compensation path 111; and a second electrical compensation path 121. The first electrical compensation path 111 and the second electrical compensation path 121 are coupled in parallel between a first node 140 and the first input 104 to provide the first noise canceling signal $-y_2(k)$. The first node 140 provides a prediction of the noise source 102.

The first electrical compensation path 111 and the second electrical compensation path 121 are coupled by a third subtraction unit 153 to the first input 104.

The active noise cancellation device 700 includes a delay element 151 coupled between the first input 104 and the first node 140 for providing the feed-backward prediction of the noise source 102.

The active noise cancellation device 700 further includes a third input 202 for receiving a far-end speaker signal s(k). The third input 202 is coupled together with the first output 106 to the canceling loudspeaker 107. The active noise cancellation device 700 further includes a fifth reproduction filter 215 coupled between the third input 202 and an error input of the first adaptation circuit 131, the fifth reproduction filter 215 reproducing an electrical estimate $h_{Ns'}$ of the secondary acoustic path 105. The device 700 includes a sixth reproduction filter 217 coupled between the canceling loudspeaker 107 and the first input 104, the sixth reproduction filter 217 reproducing an electrical estimate $h_{Ns'}$ of the secondary acoustic path 105. The device 700 includes a second subtraction unit 227 configured to subtract an output of the fifth reproduction filter 215 from an output of the third subtraction unit 153 to provide an error signal 204 to the first adaptation circuit 131. The device 700 includes a first subtraction unit 223 configured to subtract an output of the sixth reproduction filter 217 from the output of the third subtraction unit 153 to provide a compensation signal to the delay element 151 which compensation signal is provided as far-end speech with noise d'(k)+n'(k) at a third output 208.

The first electrical compensation path 111 includes a first reproduction filter 115 cascaded with a first adaptive filter 113, the first reproduction filter 115 reproducing an electrical estimate $h_{Ns'}$ of the secondary acoustic path 105. The second electrical compensation path 121 includes a replica 123 of the first adaptive filter 113 cascaded with a second reproduction filter 125 reproducing the electrical estimate $h_{Ns'}$ of the secondary acoustic path 105. A first tap 120 between the replica 123 of the first adaptive filter 113 and the second reproduction filter 125 is coupled to the first output 106.

The Modified FB ANC system with far-end signal compensation 700, see FIG. 17, is a particular case of the General ANC system 100, see FIG. 11 (*a,b,c*). It simultaneously uses two technologies, presented in FIGS. 9 and 10, in FB part of the ANC system. This allows to use in the architecture 700, see FIG. 17, the gradient search based Adaptive Algorithms with maximal step-size $\mu_{max}$, defined in equation (22), or the efficient RLS Adaptive Algorithms in the both cases: when there is or there is not the sound s(k) (far-end speech or music, coming from sound-reproducing systems or networks), eliminated by a loudspeaker, that also produces anti-noise. The solution accelerates the adaptation of the Modified FB ANC system 700, see FIG. 17, and allows it to operate, when there is the sound s(k).

The Modified FB ANC system with far-end signal compensation 700, see FIG. 17, can be also viewed as the combination of Modified FB ANC system 200, see FIG. 12, and FB ANC system with far-end signal compensation 400, see FIG. 14.

Here, the far-end signal free error signal $\alpha_2''(k)$ for the modified adaptive filter 113 is determined in 3 steps as $$\begin{aligned} d_2'(k) &= \alpha_2(k) - [-z_2'(k)] \\ &= d(k) + n(k) + s_2(k) - z_2(k) - [-z_2'(k)] = \\ &= d(k) + n(k) + s_2(k) - z_2(k) + z_2'(k) \end{aligned} \tag{54}$$

$$\begin{aligned} \alpha_2'(k) &= d_2'(k) - y_2'(k) \\ &= d(k) + n(k) + s_2(k) - z_2(k) + z_2'(k) - z_2'(k) = \\ &= d(k) + n(k) + s_2(k) - z_2(k) \\ &= \alpha_2(k) \end{aligned} \tag{55}$$

and $$\begin{aligned} \alpha_2''(k) &= \alpha_2'(k) - s_2'(k) \\ &= d(k) + n(k) + s_2(k) - z_2(k) - s_2'(k) \\ &\approx d(k) + n(k) - z_2(k). \end{aligned} \tag{56}$$

The input signal for the adaptive filter 113 is estimated as $$\begin{aligned} u_2(k) &= \alpha_2'(k) - [s_2'(k) - z_2'(k)] = \\ &= d(k) + n(k) + s_2(k) - z_2(k) - s_2'(k) + z_2'(k) \\ &\approx d(k) + n(k). \end{aligned} \tag{57}$$

The signal as defined in equation (57) is also used for noise activity detection.

Figure 18:
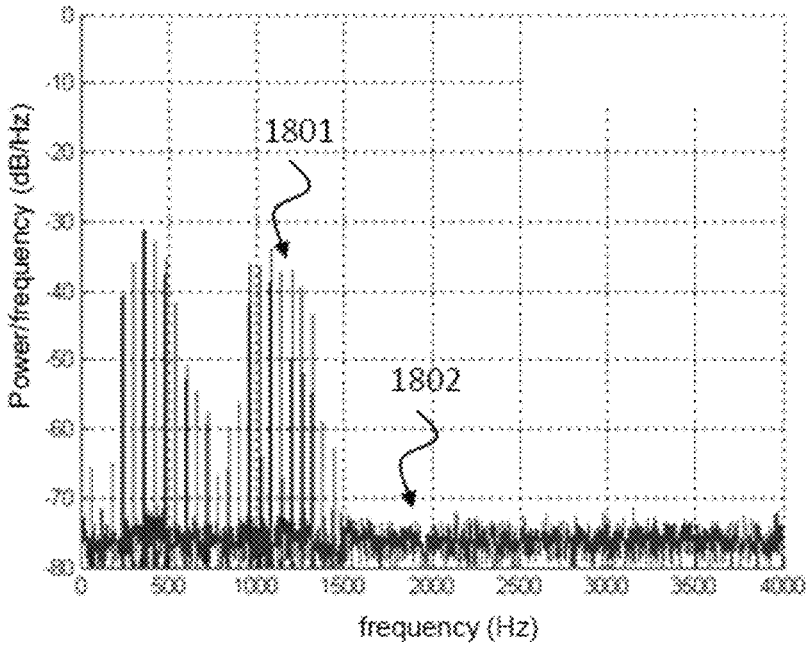
FIG. 18 shows a performance diagram 1800 illustrating power spectral density in frequency domain for Hybrid ANC systems according to an implementation form.

FIG. 18 shows a performance diagram illustrating power spectral density in frequency domain 1800 for Hybrid ANC systems according to an implementation form.

To evaluate the performance of the systems described in this disclosure, a number of simulations have been conducted. For the simulations of acoustic environment, it is required to have two impulse responses: for primary and secondary paths. The impulse responses can be measured from real world environment or can be calculated, based on the mathematical model of the environment. Below, the impulse responses are obtained by means of the calculation. The details of the impulse responses calculation is out the scope of the disclosure. The calculation can be, for example, based on open-source s/w tools.

Jont B. Allen, "Image method for efficiently simulation small-room acoustics," Journal of Acoustical Society of America, vol. 65, No. 4, pp. 943-950, April 1979, which is incorporated by reference, describes an image method for simulating small-room acoustics.

The required impulse responses were calculated for a rectangular room with dimensions $L_x$=4 m, $L_y$=5 m and $L_z$=3 m. Wall reflection coefficient are defined by a vector [0.9; 0.7; 0.7; 0.85; 0.8; 0.9], where each of the coefficient corresponds the walls with coordinates x=$L_x$ m, x=0 m, y=$L_y$ m, y=0 m, z=$L_z$ m, z=0 m. The primary path impulse response is determined between two points of the rooms with coordinates [$x_r$, $y_r$, $z_r$]=[2, 2, 1.5] m and [$x_e$, $y_e$, $z_e$]=[3, 2, 1.5] m, where the lower index r denotes the reference microphone position and the lower index e denotes the error microphone position. Secondary path is determined between a loudspeaker, located in the point [$x_s$, $y_s$, $z_s$]=[2.75, 2, 1.5] m, where lower index s denotes the loudspeaker position.

In the simulation, the following relation is used: $h_{N_{S'}}=h_{N_S}$. The number of the weights in the vector $h_{N_P}$ was selected as $N_P$=512. The number of the weights in the vectors $h_{N_{S'}}=h_{N_S}$ were selected as $N_{s'}=N_s$=256. The number of the weights of adaptive filters were selected as $N=N_1=N_2$=512.

The acoustic impulse responses are sampled at $F_S$=8,000 Hz frequency. The simulation can be conducted with any other impulse responses and other sampling frequencies as well. The only restriction is that the ANC system has to be realizable.

For that in the experiments the reference microphone, the loudspeaker and error microphone are installed in series order along x axis. In means, that delay (due to sound wave propagation in air) in the secondary path is less comparing with that of primary path in the case. This allows to process the signals, accepted by the reference and error microphones, and to generate anti-noise before the noise wave travels through the air from the reference microphone to the error one.

The ANC performance demonstration was conducted for the Modified Hybrid ANC system 300, see FIG. 13. The simulation (in MATLAB software) was conducted for two sorts of noise: wideband (WGN x(k) with $F_S/2$ Hz bandwidth and variance $\sigma_x^2$=1) and band limited multi-tone signal with the following parameters:

$$x(k) = \sum_{i=1}^{I} A_i \sin\left(2\pi f_0 i \frac{k}{F_S} + \varphi_i\right), \tag{57}$$

where $f_0$=60 Hz, $\varphi_i$ is random initial phase, equally distributed within 0 . . . 2π; $A_i$ are the sin (tones) signals amplitudes, defined by the vector $$A_I=[0.01,0.01,0.02,0.2,0.3,0.4,0.3,0.2,0.1,0.07,0.02,0.01,0.01,0.01,0.02,0.2,0.3,0.4,0.3,0.2,0.1,0.07,0.02,0.011]_I \tag{58}$$

and I=24.

FIG. 18 demonstrates in graphic form only multi-tone signal simulation case.

The additive WGN n(k) is added to error microphone, see FIGS. 5-7, 9-17. Besides the similar noise is added to signal x(k), processed by adaptive filters of ANC system. As a simplification the noise is not shown in FIGS. 6, 7, 9-17.

The noise is not added to the input signal x(k) of the primary path simulation filter $h_{N_P}$.

These two independent sources of additive noise are used to simulate the noise, that appears, for example, due to ADC signal quantization, amplifiers thermal noise etc., i.e. irremovable disturbances, that effect on the performance of any sort of adaptive filtering algorithms, and generally restrict ANC system efficiency in terms of the achievable attenuation of the noise d(k).

The effect of the noise value on ANC system calculation is out the scope of the disclosure. In the simulation, the noise variance was selected as $\sigma_n^2=10^{-4}$.

The Signal-to-Noise Ratio (SNR) at error microphone in case of signal x(k) as WGN was $$SNR = 101\ \mathrm{g}\frac{\sigma_d^2}{\sigma_n^2} \approx 23\ \mathrm{dB}. \tag{59}$$

In case of signal x(k) as multi-tone one (56) the SNR was $$SNR = 101\ \mathrm{g}\frac{\sigma_d^2}{\sigma_n^2} \approx 20\ \mathrm{dB}. \tag{60}$$

In FIG. 18, the curve 1801 represents noise d(k); and the curve 1802 is attenuated noise α(k), containing additive noise n(k). Due to this noise, α(k) does not decrease below the additive noise n(k).

The noise attenuation, defined as $$A = 101\ g\frac{\sigma_d^2}{\sigma_e^2 + \sigma_n^2}, \tag{61}$$

for the experiments is presented in Table 1.

TABLE 1

ANC system performance for WGN x(k)

| ANC type | μ = 0.0005 | μ = 0.001 | μ = 0.002 | μ = 0.005 |
|---|---|---|---|---|
| System 70 | A = 19.7554 dB | A = 21.0488 dB | A = 20.9811 dB | — |
| Modified system 300 | A = 21.1316 dB | A = 21.1287 dB | A = 20.5494 dB | A = 17.3340 dB |

The System 70 with μ=0.005 is unstable. So, no result is presented in the corresponding cell of the Table 1.

It follows from FIG. 18 and Table 1, that the considered ANC architecture provides about the same steady-state attenuation as the system 70 described above with respect to FIG. 7, that is matched with general theory of adaptive filters, e.g. as described, for example, in Sayed, Diniz, Dzhigan, Farhang-Boroujeny, and Haykin, but have different transient response duration, because the "total" number of weights of adaptive filters is different: $N_T=N_1+N_{S'}=512+256=768$ in the ANC system 70 and $N_T=N_1+N_{S'}=512$ in Modified ANC system 300.

So, under the same values of step-size μ the ANC system 70 with more weights has longer transient response and ANC system 300 with less weights (Modified one) has shorter transient response. This demonstrates an advantage of Modified ANC system 300 over system 70. Besides, because $\mu_{max}$ value is restricted as in equations (13) and (22), the ANC system 70 becomes unstable since some μ values, while Modified ANC system 300 is still stable in the case, providing a small transient response with enlarged μ value.

The similar results and conclusions are also valid for the performance of the considered ANC system with multi-tone signal x(k), see equation (57). The results are presented in Table 2.

TABLE 2

ANC system performance for multi-tone x(k)

| ANC type | μ = 0.0001 | μ = 0.0002 | μ = 0.0004 |
|---|---|---|---|
| System 70 | A = 18.1469 dB | A = 18.6322 dB | — |
| Modified system 300 | A = 18.6432 dB | A = 18.8154 dB | A = 18.9599 dB |

An example of ANC system performance in frequency domain is shown in FIG. 18. Here, PSD is presented.

The System 70 with μ=0.004 is unstable. So, no result is presented in the corresponding cell of the Table 2.

The curves 1801 in PSD pictures are related to PSD of d(k)+n(k) signal (noise to be attenuated) and the curves 1802 are related to PSD of α(k) signal (attenuated noise).

It was already said, the RLS adaptive filtering algorithms cannot be used in system 70. This is confirmed by means of simulation, presented in Table 3.

TABLE 3

ANC system performance with RLS algorithms

| ANC type | WGN | Multi-tone noise |
|---|---|---|
| System 70 | — | — |
| Modified system 300 | A = 21.8570 dB | A = 19.2743 dB |

The System 70 with RLS algorithm is unstable. So, no result is presented in the corresponding cells of the Table 3.

The RLS algorithm simulations were conducted with forgetting parameter λ=0.9999 and the parameter $\delta^2=0.001$ of the initial regularization of correlation matrix. For the parameters, see the description of the RLS adaptive filtering algorithms, e.g. as described, for example in Sayed, Diniz, Dzhigan, Farhang-Boroujeny, and Haykin.

Thus, it follows from FIG. 18 and Tables 1 to 3, that system 70 and Modified ANC system 300, based on LMS adaptive filtering algorithm, and Modified ANC system 300, based on RLS adaptive filtering algorithm, provide about the same steady-state noise attenuation.

Modified ANC system 300, based on LMS adaptive filtering algorithm, has a shorter transient response duration comparing with that of ANC system 70, if the same step-size value μ is selected.

As the step-size increases, transient response in each of ANC systems is decreased. However, the ANC system 70 may become instable under some step-size value, because the value exceed $\mu_{max}$ for this architecture, while Modified ANC system 300 remains stable, because its $\mu_{max}$ value is bigger than that of the ANC system 70, see equations (13) and (22). Transient response duration in the RLS algorithm is the smallest, comparing with that of the LMS algorithm. Besides, the duration does not depend of type of the processed signal.

So, the above result of simulation demonstrates the overall better performance of Modified ANC architectures 300 and similar the ANC architectures described above with respect to FIGS. 11 (*a,b,c*), 12 and 14-17 compared with the simple ANC architectures 70. The same result can be achieved in Hybrid ANC systems with far- and signal compensation (see FIG. 11 (*a,b,c*) and FIG. 15) due to the signal compensation.

Figure 19:
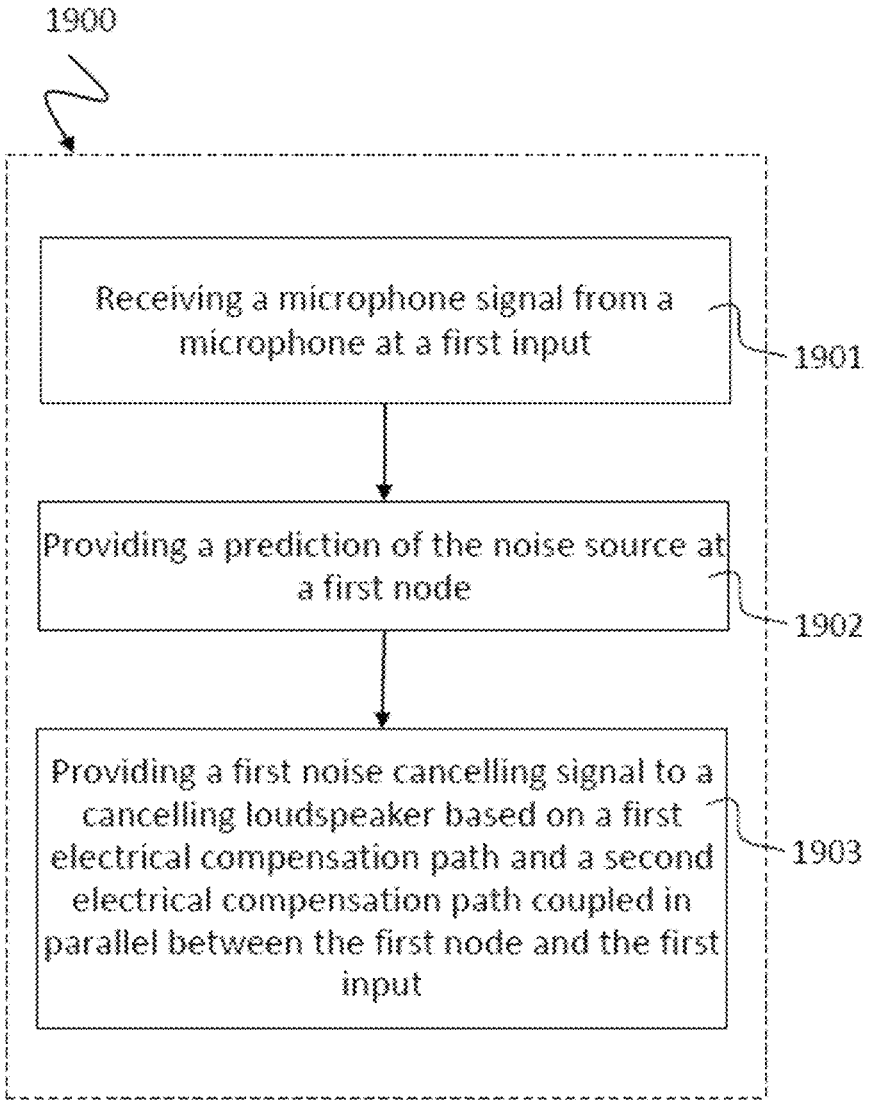
FIG. 19 shows a schematic diagram illustrating a method 1900 for active noise control.

FIG. 19 shows a schematic diagram illustrating a method 1900 for active noise control. The method 1900 includes: Receiving 1901 a microphone signal from a microphone at a first input, e.g. as described above with respect to FIGS. 11 to 17. The method 1900 includes: Providing 1902 a prediction of the noise source at a first node, e.g. as described above with respect to FIGS. 11 to 17. The method 1900 includes: Providing 1903 a first noise cancelling signal to a cancelling loudspeaker based on a first electrical compensation path and a second electrical compensation path coupled in parallel between the first node and the first input, e.g. as described above with respect to FIGS. 11 to 17.

The new ANC architectural solutions, can be used for acoustic noise cancellation in a number of industrial applications; in medical equipment like magnetic resonance imaging; in air ducts; in high quality headsets, headphones, handset etc., where it is required to reduce background noise in a location of a listener.

The following examples describe further implementations:

Example 1 is an architecture of the Modified Hybrid ANC system 100 with far-end sound s(k) compensation, eliminated via loudspeaker in parallel with anti-noise, see FIG. 11 (*a,b,c*). The system can operate with gradient search based Adaptive Algorithms (LMS, GASS LMS, NLMS, GASS NLMS, AP, GASS AP, FAP, GASS FAP) with higher value of a step-size as defined in equation (22) comparing to that as defined in equation (13) of the Hybrid ANC system architecture 70, see FIG. 7, providing a faster convergence and a stable operation. The architecture also allows a stable operation, when any of the RLS Adaptive Algorithms (including fast ones) are used. The solution accelerates the adaptation of the Modified Hybrid ANC system, see FIG. 11, and allows it to operate, when there is the sound s(k).

Example 2 is the 1-st particular case of the architecture of Example 1, that is the architecture of the Modified FB ANC system 200, see FIG. 12, that can operate with gradient search based Adaptive Algorithms (LMS, GASS LMS, NLMS, GASS NLMS, AP, GASS AP, FAP, GASS FAP) with higher value of a step-size as defined in equation (22) comparing to that as defined in equation (13) of the FB ANC system architecture 60, see FIG. 6, providing faster convergence and stable operation. The architecture also allows a stable operation, when any of the RLS Adaptive Algorithms (including fast ones) are used. The solution accelerates the adaptation of the Modified FB ANC system 200, see FIG. 12.

Example 3 is the 2-nd particular case of the architecture of Example 1, that is the architecture of the Modified Hybrid ANC system 300, see FIG. 13, that can operate with gradient search based Adaptive Algorithms (LMS, GASS LMS, NLMS, GASS NLMS, AP, GASS AP, FAP, GASS FAP) with higher value of a step-size as defined in equation (22) comparing to that as defined in equation (13) of the Hybrid ANC system architecture 70, see FIG. 7, providing faster convergence and stable operation. The architecture also allows a stable operation, when any of the RLS Adaptive Algorithms (including fast ones) are used. The solution accelerates the adaptation of the Modified Hybrid ANC system 300, see FIG. 13.

Example 4 is the 3-rd particular case of the architecture of Example 1, that is the architecture of the FB ANC system 400 with far-end sound s(k) compensation that is eliminated via loudspeaker in parallel with anti-noise, see FIG. 14. The system can operate with gradient search based Adaptive Algorithms (LMS, GASS LMS, NLMS, GASS NLMS, AP, GASS AP, FAP, GASS FAP) with step-size, defined by equation (13). I.e. only slow adaptation is allowed. The solution allows the FB ANC system 400, see FIG. 14, to operate, when there is the sound s(k).

Example 5 is the 4-th particular case of the architecture of Example 1, that is the architecture of the Hybrid ANC system 500 with far-end sound s(k) compensation that is eliminated via loudspeaker in parallel with anti-noise, see FIG. 15. The system can operate with gradient search based Adaptive Algorithms (LMS, GASS LMS, NLMS, GASS NLMS, AP, GASS AP, FAP, GASS FAP) with step-size, defined by equation (13). I.e. only slow adaptation is allowed. The solution allows the Hybrid ANC system 500, see FIG. 15, to operate, when there is the sound s(k).

Example 6 is the 6-th particular case of the architecture of Example 1, that is the architecture of the Modified FF ANC system 600 with far-end sound s(k) compensation that is eliminated via loudspeaker in parallel with anti-noise, see FIG. 16. The system can operate with gradient search based Adaptive Algorithms (LMS, GASS LMS, NLMS, GASS NLMS, AP, GASS AP, FAP, GASS FAP) with higher value of a step-size as defined by equation (22) comparing to that as defined by equation (13) of the FF ANC system architecture 50, see FIG. 5, providing a faster convergence and a stable operation. The architecture also allows having a stable operation, when any of the RLS Adaptive Algorithms (including fast ones) are used. The solution accelerates the adaptation of the Modified FF ANC system 600, see FIG. 16, and allows it to operate, when there is the sound s(k).

Example 7 is the 7-th particular case of the architecture of Example 1, that is the architecture of the Modified FB ANC system 700 with far-end sound s(k) compensation that is eliminated via loudspeaker in parallel with anti-noise, see FIG. 17. The system can operate with gradient search based Adaptive Algorithms (LMS, GASS LMS, NLMS, GASS NLMS, AP, GASS AP, FAP, GASS FAP) with higher value of a step-size as defined by equation (22) comparing to that as defined by equation (13) of the FB ANC system architecture 60, see FIG. 6, providing a faster convergence and a stable operation. The architecture also allows having a stable operation, when any of the RLS Adaptive Algorithms (including fast ones) are used. The solution accelerates the adaptation of the Modified FB ANC system 700, see FIG. 17, and allows it to operate, when there is the sound s(k).

The present disclosure supports both a hardware and a computer program product including computer executable code or computer executable instructions that, when executed, causes at least one computer to execute the performing and computing steps described herein, in particular the method 1900 as described above with respect to FIG. 19 and the techniques as described above with respect to FIGS. 11 to 17. Such a computer program product may include a readable storage medium storing program code thereon for use by a computer.

While a particular feature or aspect of the disclosure may have been disclosed with respect to only one of several implementations, such feature or aspect may be combined with one or more other features or aspects of the other implementations as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the disclosure beyond those described herein. While the present disclosure has been described with reference to one or more particular embodiments, those skilled in the art recognize that many changes may be made thereto without departing from the scope of the present disclosure. It is therefore to be understood that within the scope of the appended claims and their equivalents, the disclosure may be practiced otherwise than as specifically described herein.

What is claimed is:

1. An active noise cancellation device comprising:

a reference microphone configured to receive an acoustic noise signal;

an error microphone acoustically coupled to the reference microphone and configured to receive a filtered response of the acoustic noise signal;

a first input coupled to the error microphone and configured to receive an error signal from the error microphone;

a canceling loudspeaker acoustically coupled to the error microphone;

a first output coupled to the canceling loudspeaker and configured to provide a first noise canceling signal to the canceling loudspeaker;

a second output coupled to the canceling loudspeaker and configured to provide a second noise canceling signal to the canceling loudspeaker along a feed-forward (FF) path, the second output comprising an adaptively filtered noise signal of the acoustic noise source that is received from the reference microphone;

a subtractor coupled to the error microphone;

a first electrical compensation path coupled to the subtractor and the first input and comprising a first reproduction filter and a first adaptive filter; and a second electrical compensation path coupled to the subtractor and the first input and comprising a replica of the first adaptive filter;

a first node coupled to the first and the second electrical compensation paths and configured to provide a prediction of the acoustic noise signal;

a first adaptation circuit coupled to the first adaptive filter of the first electrical compensation path and the replica of the first adaptive filter of the second electrical compensation path, the first adaptation circuit being configured to receive the error signal and provide a same filter weight to the first adaptive filter and the replica of the first adaptive filter, the first electrical compensation path and the second electrical compensation path being positioned in parallel between the first input and the subtractor to provide the first noise canceling signal, and the subtractor being configured to:

receive both an inverted estimated feed-backward (FB) signal of the first noise canceling signal and an estimated FB signal of the first noise canceling signal; and determine the first noise canceling signal.

2. The active noise cancellation device of claim 1, further comprising:

a second node coupled to the acoustic noise signal and configured to provide a FF prediction of the acoustic noise signal;

a third electrical compensation path coupled to the first input and the second node; and a fourth electrical compensation path coupled to the first input and the second node, the third electrical compensation path and the fourth electrical compensation path being positioned in parallel between the first input and the second node, and the first node being further configured to provide a FB prediction of the acoustic noise signal.

3. The active noise cancellation device of claim 2, wherein the subtractor is configured to couple each of the third electrical compensation path and the fourth electrical compensation path to the first input.

4. The active noise cancellation device of claim 2, further comprising a delay element positioned between the first input and the first node and configured to provide the FB prediction of the acoustic noise signal.

5. The active noise cancellation device of claim 4, further comprising:

a third input coupled to at least one of the first output and the second output and configured to receive a far-end speaker signal;

a fifth reproduction filter coupled to the third input and positioned between the third input and the error signal and configured to reproduce a second electrical estimate of a secondary acoustic path; and a sixth reproduction filter coupled to the canceling loudspeaker and positioned between the first output and the first input and configured to reproduce a third electrical estimate of the secondary acoustic path.

6. The active noise cancellation device of claim 5, further comprising:

a second subtractor coupled to the fifth reproduction filter and configured to subtract an output of the fifth reproduction filter from the error signal;

a third subtractor coupled to the error microphone and configured to subtract an output of the sixth reproduction filter from the error signal; and a third output configured to output a compensation signal as far-end speech with noise.

7. The active noise cancellation device of claim 2, wherein the third electrical compensation path comprises a third reproduction filter cascaded with a second adaptive filter, and the third reproduction filter being configured to reproduce a fourth electrical estimate of a secondary acoustic path.

8. The active noise cancellation device of claim 7, wherein the fourth electrical compensation path comprises a replica of the second adaptive filter cascaded with a fourth reproduction filter that is configured to reproduce the fourth electrical estimate.

9. The active noise cancellation device of claim 8, further comprising a second tap coupled to the second output and positioned between the replica of the second adaptive filter and the fourth reproduction filter.

10. The active noise cancellation device of claim 7, wherein the first adaptation circuit is configured to adjust first filter weights of a first adaptive filter, the first reproduction filter being cascaded with the first adaptation circuit.

11. The active noise cancellation device of claim 10, further comprising a second adaptation circuit coupled to the third electrical compensation circuit and configured to adjust second filter weights of a second adaptive filter, wherein the third reproduction filter is cascaded with the second adaptation circuit.

12. The active noise cancellation device of claim 1, wherein the first reproduction filter is cascaded with the first adaptive filter, and wherein the first reproduction filter is configured to reproduce a first electrical estimate of a secondary acoustic path.

13. The active noise cancellation device of claim 12, wherein the second electrical compensation path comprises the replica of the first adaptive filter cascaded with a second reproduction filter configured to reproduce the first electrical estimate.

14. The active noise cancellation device of claim 13, further comprising a first tap coupled to the first output and positioned between the replica of the first adaptive filter and the second reproduction filter.

15. The active noise cancellation device of claim 5, further comprising:

a second subtractor coupled to the fifth reproduction filter and configured to subtract an output of the fifth reproduction filter from the error signal, the subtractor being configured to provide a compensation signal to the delay element; and a third output coupled to the subtractor and configured to output the compensation signal as far-end speech with the acoustic noise signal.

16. The active noise cancellation device of claim 5, wherein the subtractor is further configured to provide an error signal to the first adaptation circuit and second adaptation circuit, and wherein the active noise cancellation device further comprises:

a third subtractor configured to subtract an output of the sixth reproduction filter from the reference microphone; and a third output configured to output a compensation signal as far-end speech with the acoustic noise signal.

17. The active noise cancellation device of claim 5, wherein the subtractor is further configured to:

provide an error signal to the first adaptation circuit and second adaptation circuit;

provide a compensation signal to the delay element, and wherein the active noise cancellation device further comprises a third output configured to output the compensation signal as far-end speech with the acoustic noise signal.

* * * * *